US008953412B2

(12) United States Patent
Chen et al.

(10) Patent No.: US 8,953,412 B2
(45) **Date of Patent: *Feb. 10, 2015**

(54) METHOD AND ASSEMBLY FOR DETERMINING LANDING OF LOGGING TOOLS IN A WELLBORE

(71) Applicant: Halliburton Energy Services, Inc., Houston, TX (US)

(72) Inventors: Yuanhang Chen, Sugar Land, TX (US); Wei Sun, Houston, TX (US); Andrew Albert Hrametz, Rosenberg, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/119,421

(22) PCT Filed: Dec. 26, 2012

(86) PCT No.: PCT/US2012/071624
§ 371 (c)(1),
(2) Date: Nov. 21, 2013

(87) PCT Pub. No.: WO2014/105007

PCT Pub. Date: Jul. 3, 2014

(65) Prior Publication Data

US 2014/0340990 A1 Nov. 20, 2014

(51) Int. Cl.
*E21B 47/16* (2006.01)
*E21B 47/18* (2012.01)
*E21B 47/04* (2012.01)

(52) U.S. Cl.
CPC ..... *E21B 47/18* (2013.01); *E21B 47/04* (2013.01)
USPC ..... 367/82; 166/255.2; 175/45

(58) Field of Classification Search
CPC ..... E21B 23/08–23/14; E21B 47/00–47/01; E21B 47/011; E21B 47/122; E21B 17/076
USPC ..... 340/603, 606–611, 626–627, 632, 340/853.1–856.4; 73/152.01–152.62, 73/863.02, 863.22; 166/66, 250.01–255.3; 175/40–48; 367/81–86
See application file for complete search history.

(56) References Cited

U.S. PATENT DOCUMENTS 3,378,069 A 4/1968 Fields
4,041,780 A 8/1977 Angehrn
(Continued)

FOREIGN PATENT DOCUMENTS

FR 2910048 A1 6/2008
FR 2910049 A1 6/2008
(Continued)

OTHER PUBLICATIONS

Authorized Officer Helene Henke-Houet, International Search Report and Written Opinion in International Application No. PCT/US2012/044540, Issued by European Patent Office, mailed, Nov. 11, 2013, 38 pages.
(Continued)

*Primary Examiner* — Hai Phan
*Assistant Examiner* — Orlando Bousono
(74) *Attorney, Agent, or Firm* — Anthony Iannitelli; Fish & Richardson P.C.

(57) ABSTRACT

An assembly using an onboard controller employs sensors to precisely determine the landing status of downhole logging tools. A control algorithm of the onboard controller can enable an intelligent management of the battery system and memory system of the logging tools. Sensors are used to verify landing having been reached. The sensors may include a real time clock, a pressure sensor, a temperature sensor, and a proximity/position sensor. The sensors can send measurement signals to the controller for determining if the measurement values are within an acceptable range indicating the logging tools having landed. As a correct landing has been confirmed or verified, the controller can trigger an onset for data logging (e.g., powering up the battery system and/or memory system). A method of determining landing of a logging tool in a wellbore is disclosed.

36 Claims, 20 Drawing Sheets

(56) References Cited

U.S. PATENT DOCUMENTS

| | | | | |
|---|---|---|---|---|
| 4,349,072 | A | 9/1982 | Escaron et al. | |
| 4,485,870 | A | 12/1984 | Walulik | |
| 4,597,440 | A | 7/1986 | Pottier | |
| 4,664,189 | A | 5/1987 | Wittrisch | |
| 4,715,446 | A | 12/1987 | Wittrisch | |
| 4,729,429 | A | 3/1988 | Wittrisch | |
| 4,783,995 | A | 11/1988 | Michel et al. | |
| 4,790,380 | A | 12/1988 | Ireland et al. | |
| 4,807,717 | A | 2/1989 | Winters et al. | |
| 5,111,880 | A | 5/1992 | Wittrisch et al. | |
| 5,217,075 | A | 6/1993 | Wittrisch | |
| 5,566,757 | A | 10/1996 | Carpenter et al. | |
| 5,589,825 | A * | 12/1996 | Pomerleau | 340/854.9 |
| 6,119,777 | A | 9/2000 | Runia | |
| 6,419,013 | B1 | 7/2002 | Milne et al. | |
| 6,488,085 | B1 | 12/2002 | Milne et al. | |
| 6,578,631 | B2 | 6/2003 | Milne et al. | |
| 6,755,257 | B2 * | 6/2004 | Spencer et al. | 166/383 |
| 6,843,317 | B2 | 1/2005 | Mackenzie | |
| 7,188,672 | B2 | 3/2007 | Berkheimer et al. | |
| 7,201,231 | B2 | 4/2007 | Chaplin et al. | |
| 7,363,967 | B2 | 4/2008 | Burris, II et al. | |
| 7,537,061 | B2 | 5/2009 | Hall et al. | |
| 7,661,475 | B2 | 2/2010 | Sheiretov et al. | |
| 7,905,282 | B2 | 3/2011 | Bissonnette et al. | |
| 8,022,838 | B2 | 9/2011 | Murphy | |
| 8,561,697 | B2 | 10/2013 | Strickland | |
| 8,689,867 | B2 | 4/2014 | MacDougall et al. | |
| 2002/0057210 | A1 * | 5/2002 | Frey et al. | 340/854.3 |
| 2002/0117300 | A1 | 8/2002 | Spencer et al. | |
| 2003/0056984 | A1 * | 3/2003 | Smith et al. | 175/40 |
| 2003/0058125 | A1 | 3/2003 | Ciglenec et al. | |
| 2004/0069488 | A1 * | 4/2004 | Chaplin et al. | 166/254.2 |
| 2004/0245020 | A1 * | 12/2004 | Giroux et al. | 175/61 |
| 2005/0167098 | A1 | 8/2005 | Lovell et al. | |
| 2006/0054354 | A1 * | 3/2006 | Orban | 175/40 |
| 2006/0118298 | A1 | 6/2006 | Millar et al. | |
| 2006/0220651 | A1 * | 10/2006 | Clark | 324/368 |
| 2007/0119626 | A9 * | 5/2007 | Giroux et al. | 175/61 |
| 2007/0284116 | A1 | 12/2007 | Hall et al. | |
| 2008/0093124 | A1 * | 4/2008 | Giroux et al. | 175/45 |
| 2008/0110673 | A1 * | 5/2008 | Giroux et al. | 175/5 |
| 2008/0202767 | A1 | 8/2008 | Sheiretov et al. | |
| 2008/0236841 | A1 * | 10/2008 | Howlett et al. | 166/381 |
| 2009/0014175 | A1 * | 1/2009 | Peter | 166/254.2 |
| 2009/0045975 | A1 | 2/2009 | Evans et al. | |
| 2009/0194271 | A1 | 8/2009 | Bissonnette et al. | |
| 2009/0272580 | A1 * | 11/2009 | Dolman et al. | 175/48 |
| 2010/0089567 | A1 | 4/2010 | Constantinou et al. | |
| 2010/0108332 | A1 * | 5/2010 | Chaplin et al. | 166/386 |
| 2011/0011646 | A1 * | 1/2011 | Giroux et al. | 175/61 |
| 2011/0083845 | A1 | 4/2011 | McLaughlin | |
| 2011/0308797 | A1 | 12/2011 | Umphries et al. | |
| 2012/0067594 | A1 * | 3/2012 | Noske et al. | 166/373 |
| 2012/0168228 | A1 * | 7/2012 | Giroux et al. | 175/57 |
| 2013/0118752 | A1 * | 5/2013 | Hannegan et al. | 166/336 |

FOREIGN PATENT DOCUMENTS

| | | | |
|---|---|---|---|
| GB | 2344123 | A | 5/2000 |
| WO | WO 00/17488 | | 3/2000 |
| WO | 0060212 | | 10/2000 |
| WO | WO 02/073003 | A1 | 9/2002 |
| WO | 2010089525 | | 8/2010 |
| WO | WO 2013/133860 | | 9/2013 |
| WO | WO 2013/133861 | | 9/2013 |
| WO | WO 2013/133890 | | 9/2013 |

OTHER PUBLICATIONS

Authorized Officer Helene Henke-Houet, International Search Report and Written Opinion in International Application No. PCT/US2012/044544, Issued by European Patent Office, mailed, Nov. 11, 2013, 28 pages.

Authorized Officer Nathalie Kermani, International Search Report and Written Opinion in International Application No. PCT/US2012/071624, Issued by European Patent Office, mailed Oct. 9, 2013, 28 pages.

John Runia et al., "Through Bit Logging: Applications in Difficult Wells, Offshore North Sea" SPE/IADC 92256, Feb. 23-25, 2005, 8 pages.

John Runia et al., "Through Bit Logging: A New Method to Acquire Log Data, and a First Step on the Road to Through Bore Drilling" SPWLA 45$^{th}$ Annual Logging Symposium, Jun. 6-9, 2004, 8 pages.

Authorized Officer Lee, Jong Kyung, International Search Report and Written Opinion in International Application No. PCT/US2013/037413, Jan. 20, 2014, 16 pages.

Authorized Officer Ott, Stephane, International Search Report and Written Opinion in International Application No. PCT/US2012/071986, Jan. 8, 2014, 15 pages.

Runia et al., "Through Bit Logging: A New Method to Acquire Log Data, and a First Step on the Road to Through Bore Drilling" SPWLA 45$^{th}$ Annual Logging Symposium, Jun. 6-9, 2004, 8 pages.

Runia et al., "Through Bit Logging: Applications in Difficult Wells, Offshore North Sea" SPE/IADC 92256, Feb. 23-25, 2005, 8 pages.

* cited by examiner

B

243

251

METHOD AND ASSEMBLY FOR DETERMINING LANDING OF LOGGING TOOLS IN A WELLBORE

BACKGROUND

This disclosure relates to devices, methods and assemblies for determining landing of logging tools in a well.

In oil and gas exploration it is important to obtain diagnostic evaluation logs of geological formations penetrated by a wellbore from a subterranean reservoir. Diagnostic evaluation well logs are generated by data obtained by diagnostic tools (referred to in the industry as logging tools) that are lowered into the wellbore and passed across geologic formations that may contain hydrocarbon substances. Examples of well logs and logging tools are known in the art. Examples of diagnostic well logs include Neutron logs, Gamma Ray logs, Resistivity logs and Acoustic logs. Logging tools are frequently used for log data acquisition in a wellbore by logging in an upward (up hole) direction, such as from a bottom portion of the wellbore to an upper portion of the wellbore. The logging tools, therefore, need first be conveyed to the bottom portion of the wellbore. The landing position of the logging tools relative to the drill pipe (e.g., being at the end of the drill pipe) is important information for determining when to initiate data logging sequences and other aspects of logging tool operations. For example, logging tools may be in an inactive (e.g., sleep-mode) before landing at the end of the drill pipe for conserving onboard energy, reducing recording memory waste or unwanted data logs, and avoiding other potential interference incidents.

SUMMARY

The present disclosure relates to devices, methods and assemblies for detecting landing of logging tools in a drill string disposed in a wellbore.

The details of one or more embodiments are set forth in the accompanying drawings and the description below.

DETAILED DESCRIPTION

Figure 1A:
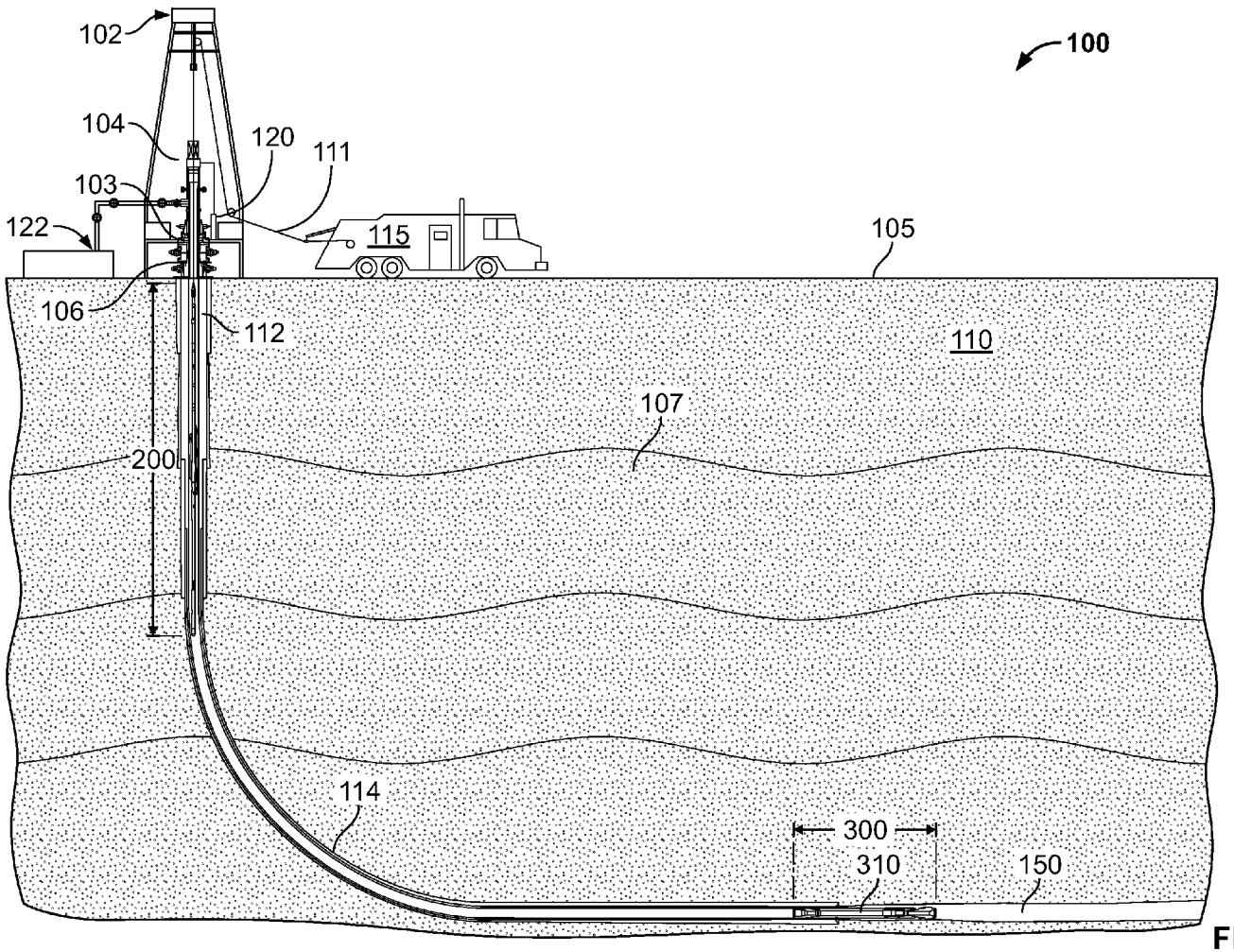
FIGS. 1A to 1E illustrate operations of a logging tool system.

The present disclosure relates to systems, assemblies, and methods for determining landing of logging tools in a bottom hole assembly of a drill string disposed in a wellbore. The disclosed logging tools landing position determination systems, assemblies, and methods can detect the relative position of the logging tools to the drill pipe and to the well. In some instances, the logging tools landing position determination system can identify if the logging tools have reached the bottom hole assembly disposed at the end of the drill pipe. The bottom hole assembly may include a landing sub assembly and a drill bit having a central opening enabling the logging tools to pass therethrough. The logging tools landing position determination can enable precise data logging onset in various well conditions. For example, certain wells can be drilled in a deviated manner or with a substantially horizontal section. In some conditions, the wells may be drilled through geologic formations that are subject to swelling or caving, or may have fluid pressures that make passage of the logging tools difficult, requiring forceful conveyance and landing, such as using high pressure fluids to power the logging tools downwards and landing the logging tools at the end of the drill pipe/string. The conveyance duration and landing condition can vary unpredictably from well to well, for variable deviation and resistance. For example, higher pressure of fluids or higher landing speed may be required for wells of higher resistance. The unpredictable resistance may affect the conveyance duration and therefore the onset of data logging (e.g., after logging tools have completely landed).

The present disclosure describes an onboard controller that can employ various sensors to precisely determine the landing status of the logging tools. A control algorithm of the onboard controller can enable an intelligent management of the battery system and memory system of the logging tools. For example, the onboard controller can conserve energy and memory consumption by keeping the logging tools in a sleep or stand-by mode before landing is confirmed. A number of sensors are used to verify landing having been reached. The sensors may include a real time clock, a pressure sensor, a temperature sensor, and a proximity/position sensor. The sensors can send measurement signals to the controller for determining if the measurement values are within an acceptable range indicating the logging tools having landed. As a correct landing has been confirmed or verified, the controller can trigger an onset for data logging (e.g., powering up the battery system and/or memory system). In some implementations, the onboard controller can provide reliable indication of the logging tool string landing in the landing sub of the bottom hole assembly in the drill string such that battery power and onboard memory can be conserved for use in the actual data logging operation (e.g., not initiated during the conveyance of the logging tools).

FIGS. 1A to 1E illustrate operations of a logging tool system 100. The logging tool system 100 includes surface equipment above the ground surface 105 and a well and its related equipment and instruments below the ground surface 105. In general, surface equipment provides power, material, and structural support for the operation of the logging tool system 100. In the embodiment illustrated in FIG. 1A, the surface equipment includes a drilling rig 102 and associated equipment, and a data logging and control truck 115. The rig 102 may include equipment such as a rig pump 122 disposed proximal to the rig 102. The rig 102 can include equipment used when a well is being logged such as a logging tool lubrication assembly 104 and a pack off pump 120. In some implementations a blowout preventer 103 will be attached to a casing head 106 that is attached to an upper end of a well casing 112. The rig pump 122 provides pressurized drilling fluid to the rig and some of its associated equipment. The data logging and control truck 115 monitors the data logging operation and receives and stores logging data from the logging tools. Below the rig 102 is a wellbore 150 extending from the surface 105 into the earth 110 and passing through a plurality of subterranean geologic formations 107. The wellbore 150 penetrates through the formations 107 and in some implementations forms a deviated path, which may include a substantially horizontal section as illustrated in FIG. 1A. Near the surface 105, part of the wellbore 150 may be reinforced with the casing 112. A drill pipe string 114 can be lowered into the wellbore 150 by progressively adding lengths of drill pipe connected together with tool joints and extending from the rig 102 to a predetermined position in the wellbore 150. A bottom hole assembly 300 may be attached to the lower end of the drill string before lowering the drill string 114 into the wellbore.

At a starting position as shown in FIG. 1A, a logging tool string 200 is inserted inside the drill pipe string 114 near the upper end of the longitudinal bore of the drill pipe string 114 near the surface 105. The logging tool string 200 may be attached with a cable 111 via a crossover tool 211. As noted above, the bottom hole assembly 300 is disposed at the lower end of the drill string 114 that has been previously lowered into the wellbore 150. The bottom hole assembly 300 may include a landing sub 310 that can engage with the logging tool string 200 once the logging tool string 200 is conveyed to the bottom hole assembly 300. The conveying process is conducted by pumping a fluid from the rig pump 122 into the upper proximal end of the drill string 114 bore above the logging tool string 200 to assist, via fluid pressure on the logging tool string 200, movement of the tool string 200 down the bore of the drill string 114. The fluid pressure above the logging tool string 200 is monitored constantly, for example, by the data logging control truck, because the fluid pressure can change during the conveying process and exhibit patterns indicating events such as landing the tool string 200 at the bottom hole assembly 300. As the tool string 200 is pumped (propelled) downwards by the fluid pressure that is pushing behind the tool string 200 down the longitudinal bore of the drill pipe string 114, the cable 111 is spooled out at the surface. It will be understood that, in some implementations, the tool string 200 may be inserted proximal to the upper end of the drill pipe string 114 near the surface 105 without being connected to the cable 111 (e.g., a wireline, E-line or Slickline); and the tool string 200 can be directly pumped down (e.g., without tension support from the surface 105) the drill pipe string 114 and landed in the bottom hole assembly 300 as described herein.

Figure 1B:
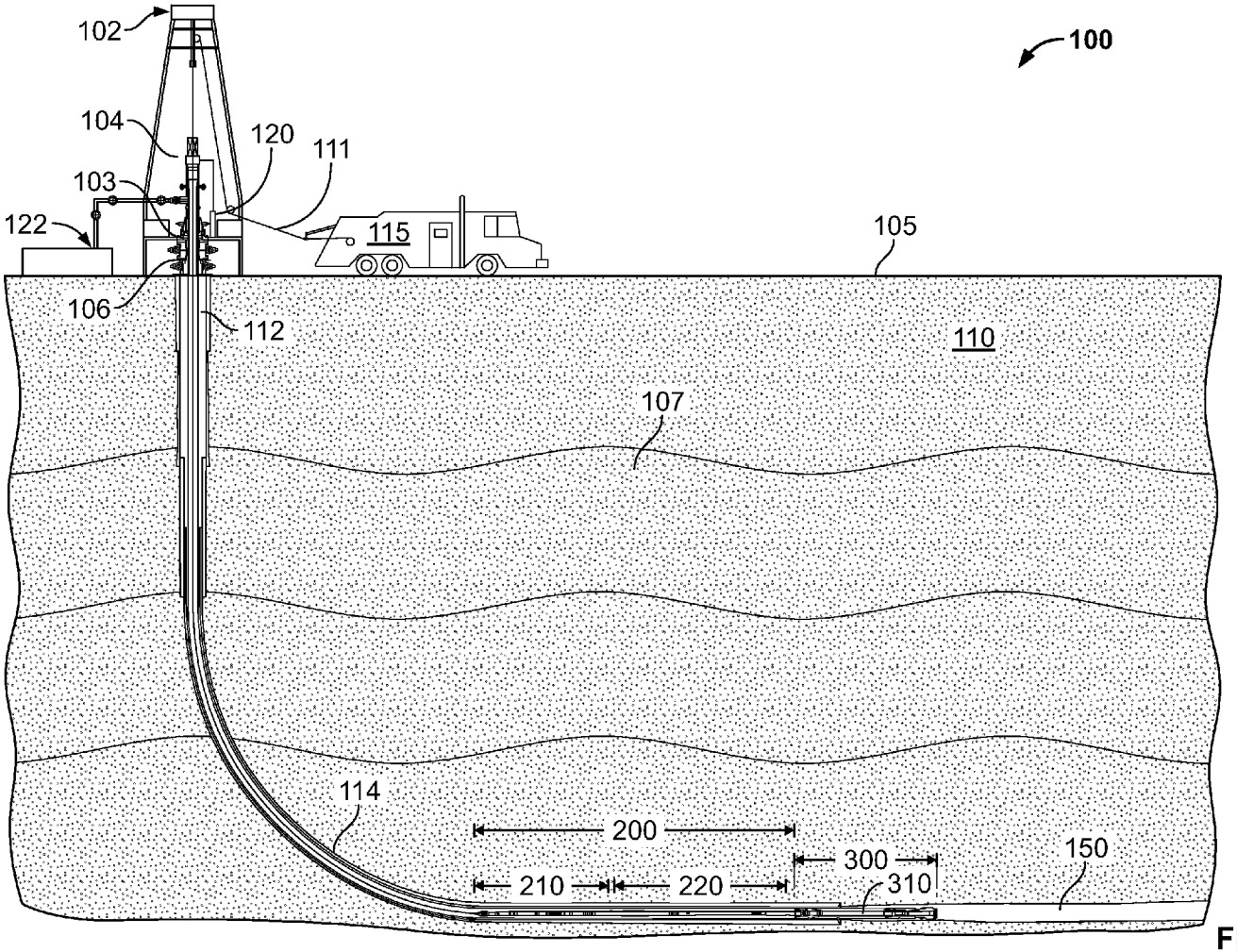

In FIG. 1B, the logging tool string 200 is approaching the bottom hole assembly 300. The tool string 200 is to be landed in the landing sub 310 disposed in the bottom hole assembly 300 which is connected to the distal lower portion of the drill pipe string 114. At least a portion of the tool string 200 has logging tools that, when the tool string is landed in the bottom hole assembly 300, will be disposed below the distal end of the bottom hole assembly of the drill pipe string 114. In some implementations, the logging tool string 200 includes two portions: a landing assembly 210 and a logging tool assembly 220. As illustrated in FIG. 1B, the landing assembly 210 is to be engaged with the bottom hole assembly 300 and the logging tool assembly 220 is to be passed through the bottom hole assembly 300 and disposed below the bottom hole assembly. This enables the logging tools to have direct access to the geologic formations from which log data is to be gathered. Details about the landing assembly 210 and the logging tool assembly 220 are described in FIGS. 2A to 2E. As the tool string 200 approaches the bottom hole assembly 300, the rig pump 122 fluid pressure is observed at the surface 105; for example, at the data logging control truck 115.

Figure 1C:
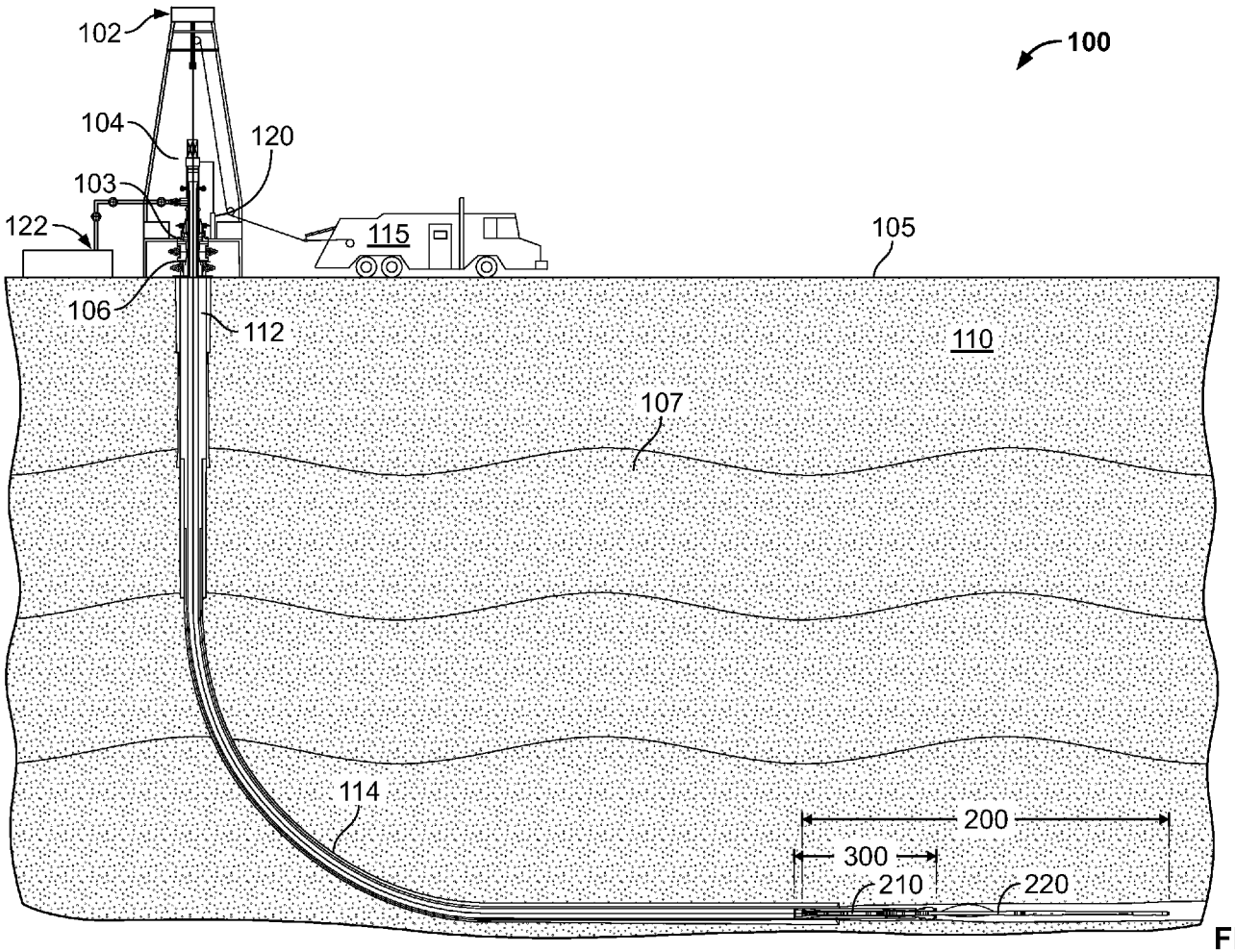

In FIG. 1C, the logging tool string 200 has landed and engaged with landing sub 310 of the bottom hole assembly 300. The landing of the logging tool string 200 may be monitored by a landing onboard controller carried in the logging tool string 200. The onboard controller can employ various sensors to determine if the logging tool string 200 has successfully landed in the bottom hole assembly 300. For example, the onboard controller may measure pressure, temperature, time, vibration, and other physical parameters to determine if the logging tool string 200 has engaged at a correct position with respect to the bottom hole assembly 300. Details of the onboard controller are described in the following figures. In some implementations, a sudden increase of the fluid pressure can indicate that the tool string 200 has landed in the landing sub 310 of the bottom hole assembly 300. The fluid pressure increases because the fluid is not able to circulate past the outside of the upper nozzle 245 when it is seated in the nozzle sub 312. This fluid pressure increase may be monitored by the onboard controller with sensors onboard the logging tool string 200, or may be monitored by a computer system on the surface 105. After a proper landing of the logging tool string 200 has been confirmed, a self-activating diagnostic sequence can be automatically initiated by a diagnostic module located in the logging tool assembly 220 to determine if the logging tool assembly 220 is functioning properly. Upon a determination that the logging tool assembly 220 is functioning properly, a data logging sequence may then be initiated.

Figure 1D:
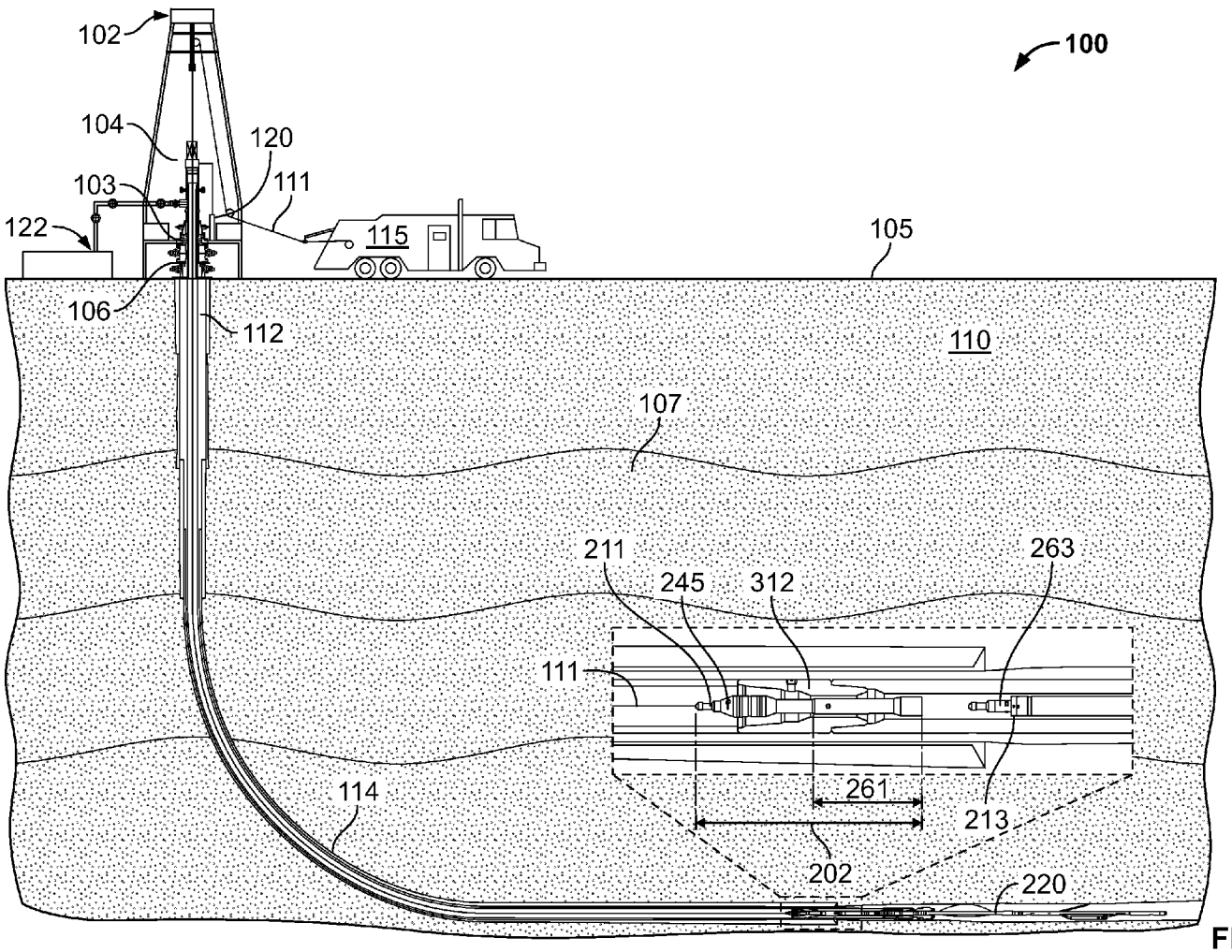

Referring now to FIG. 1D, when the proper functioning of the logging tool assembly 220 is confirmed by the downhole diagnostics module, instructions are sent from the downhole diagnostics module to the downhole motor release assembly 213 to release the running tool assembly 202 from the logging tool assembly 220 and displace the running tool 202 away from the upper end of the tool string 200. The running tool 202 includes a crossover tool 211 that connects the cable 111 to the upper nozzle 245 and the spring release assembly 261. A decrease in the pump pressure can then be observed as indicative of release and displacement of the running tool 202 from the tool string 200 which again allows fluid to freely circulate past upper nozzle 245. Once the pressure decrease has been observed at the surface 105, the cable 111 is spooled in by the logging truck 115. The motor release assembly 213 can include a motorized engagement mechanism that activates spring release dogs (not shown) that can secure or release the running tool 202 to or from the fishing neck 263. The spring release assembly 261 can include a preloaded spring (not shown) which forcibly displaces the running tool 202 from the landing nozzle 312. In some implementations, the running tool 202 may be released from the logging tool assembly 220 prior to the landing of the logging tool string 200 (e.g., released before the landing as illustrated in FIG. 1D). For example, the running tool 202 may be released from the logging tool assembly 220 when the logging tool assembly 220 has entered a substantially deviated or horizontal section in the well, where the primary driving force applied to the logging tool assembly 220 is from the fluid pressure and not gravity.

Figure 1E:
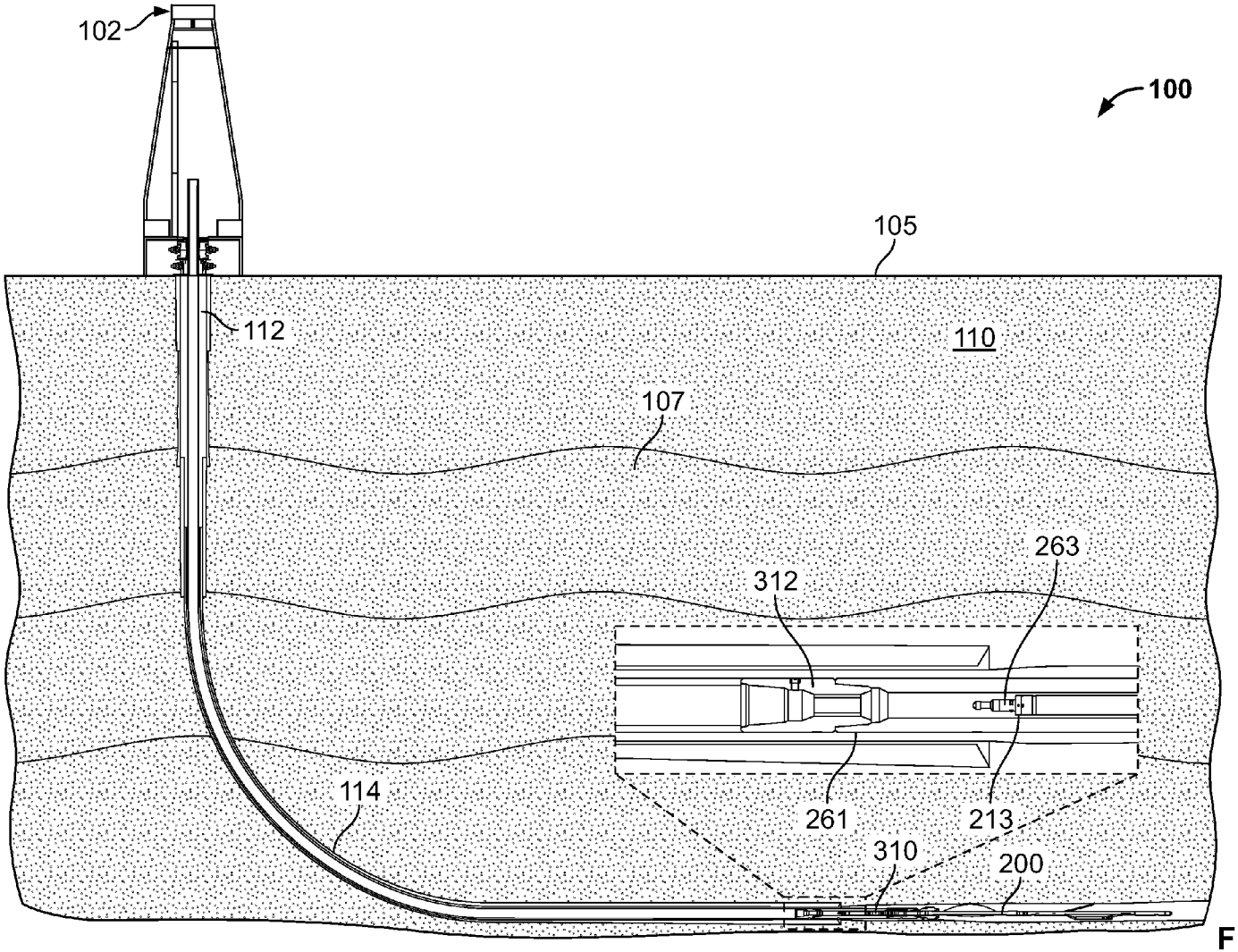

In FIG. 1E, the cable 111 and the running tool assembly 202 (shown in preceding FIGS. 1A to 1D) have been completely retrieved and removed from drill string 114. The system 100 is ready for data logging. As previously noted, in some implementations, the tool string 200 may not include a running tool 202, a crossover tool 211, or a cable 111. For example, the tool string 200 may be directly pumped down the drill pipe without being lowered on a cable 111. As discussed above, the logging tool assembly 220 is disposed below the lower end of the bottom hole assembly 300 and can obtain data from the geologic formations as the logging tool assembly 220 moves past the formations. The drill pipe string 114 is pulled upward in the wellbore 150 and as the logging tool assembly 220 moves past the geologic formations, data is recorded in a memory logging device that is part of the logging tool assembly 220 (shown in FIGS. 2A to 2E). The drill string is pulled upward by the rig equipment at rates conducive to the collection of quality log data. This pulling of the drill string 114 from the well continues until the data is gathered for each successive geologic formation of interest. After data has been gathered from the uppermost geologic formations of interest, the data gathering process is completed. The remaining drill pipe and bottom hole assembly containing the logging tool string 200 is pulled from the well to the surface 105. In some implementations, the logging tool string 200 can be removed from the well to the surface 105 by lowering on a cable 111 a fishing tool adapted to grasp the fishing neck 263 while the tool string and drill pipe are still in the wellbore. The tool grasps the fishing neck and then the cable is spooled in and the tool and the logging tool string are retrieved. The data contained in the memory module of the logging tool assembly 220 is downloaded and processed in a computer system at the surface 105. In some implementations, the computer system can be part of the data logging control truck 115. In some implementations, the computer system can be off-site and the data can be transmitted remotely to the off-site computer system for processing. Different implementations are possible. Details of the tool string 200 and the bottom hole assembly 300 are described below.

Figures 2A, 2B, 2C, 2D:
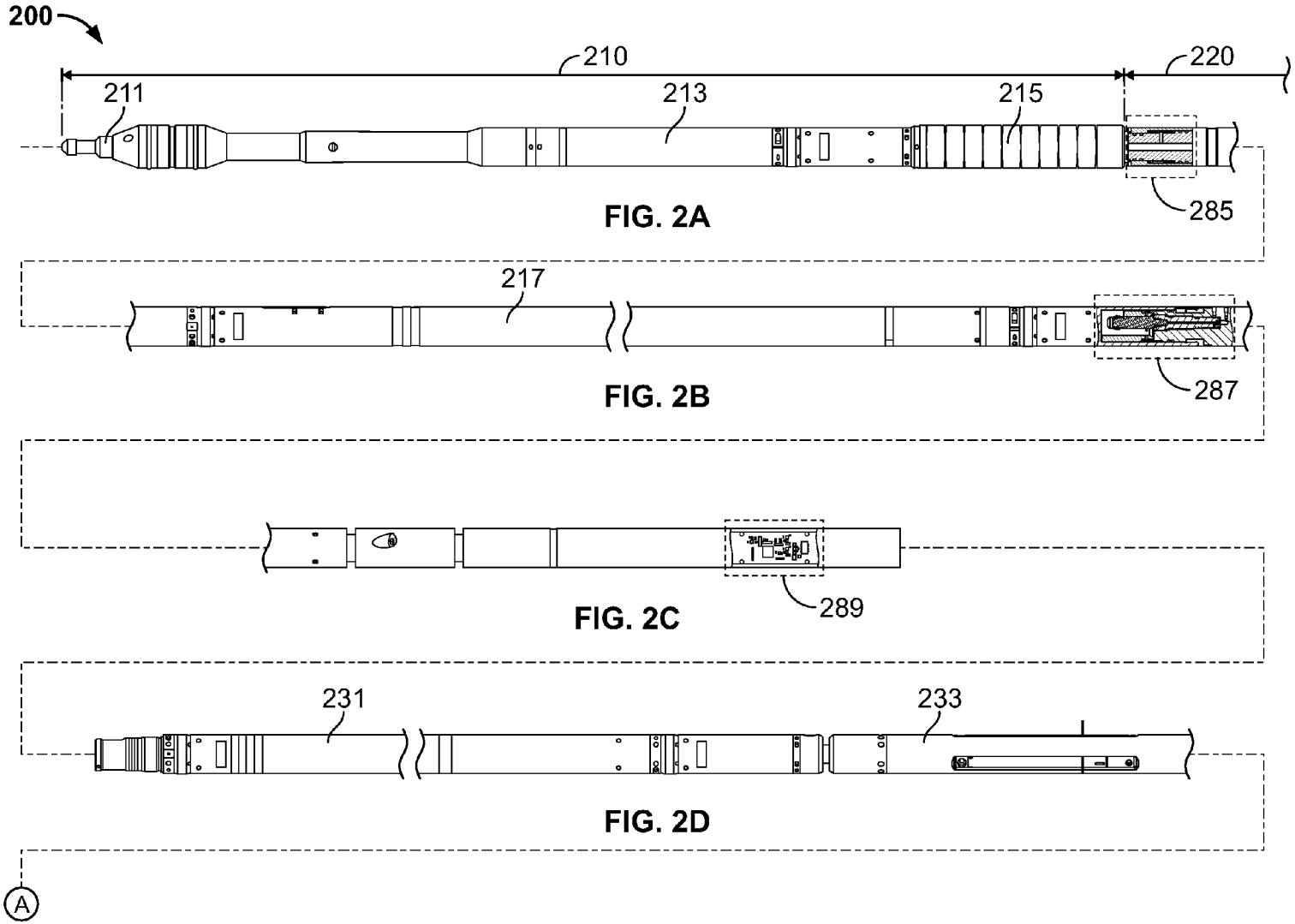
FIGS. 2A to 2K are side views of a logging tool string applicable to the operations illustrated in FIGS. 1A to 1E.

FIGS. 2A to 2K are side views of the logging tool string 200 applicable to the operations illustrated in FIGS. 1A to 1E. The logging tool string 200 includes two major sections: the landing assembly 210, and the logging assembly 220 that can be separated at a shock sub 215. Referring to FIGS. 2A and 2B, the complete section of the landing assembly 210 and a portion of the logging assembly 220 are shown. The landing assembly 210 can include a running tool 202, the crossover tool 211, a nozzle 245, a spring release assembly 261, a motorized tool assembly 213, and the shock sub 215. In many instances, the shock sub 215 of the landing assembly 210 enables the logging tool string 200 to engage with the bottom hole assembly 300 without causing damage to onboard instruments. The shock sub 215 can include various structures and/or materials to absorb impact energy of the logging tool string 200 during landing. For example, the shock sub 215 can include springs, friction dampers, magnetic dampers, and other shock absorbing structures. The running tool 202 includes a subset of the landing assembly 210, such as the crossover tool 211 and the spring release assembly 261. Retrieval of the running tool 202 will be described later herein.

Figure 5:
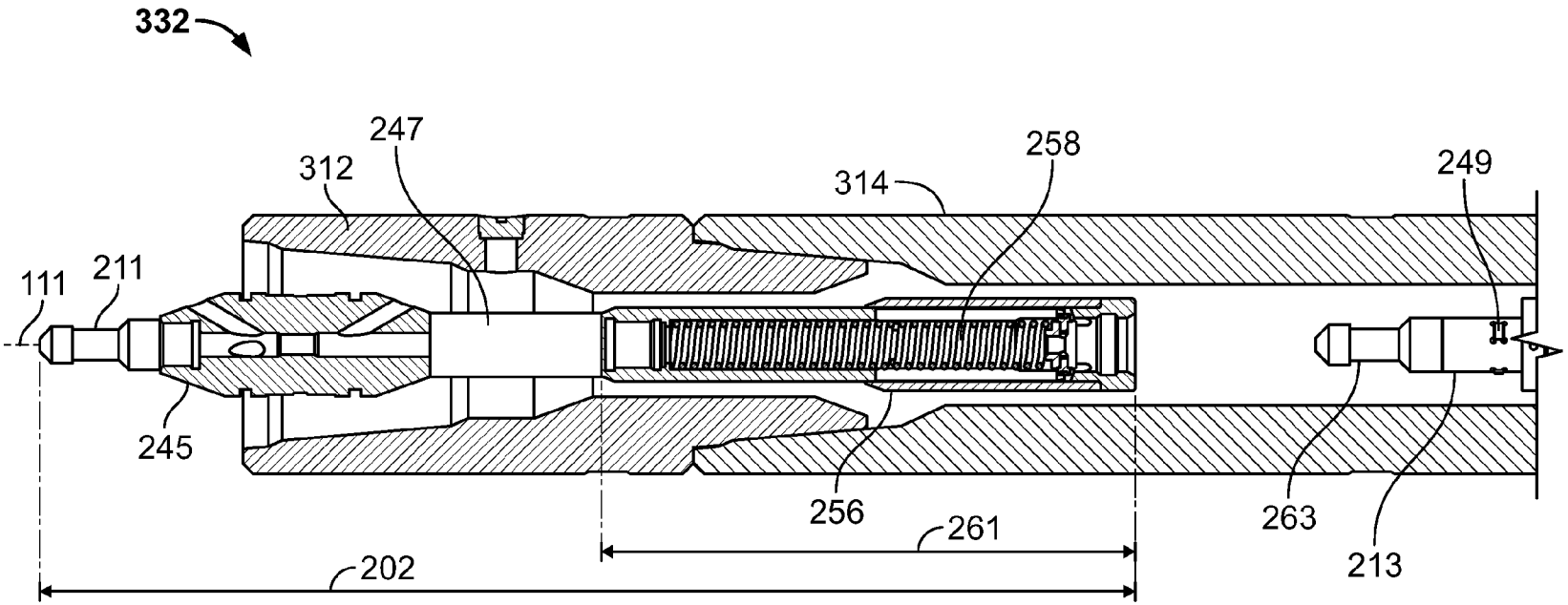
FIG. 5 is a detail half cross-section view of a portion of the logging tool string disposed in the bottom hole assembly.

Referring to the landing assembly 210, the running tool 202 is securely connected with the cable 111 by crossover tool 211. As the tool string 200 is propelled down the bore of the drill string by the fluid pressure, the rate at which the cable 111 is spooled out maintains movement control of the tool string 200 at a desired speed (e.g., maintaining a balance between variable resistance and gravity). After landing of the tool string 200 or at any appropriate time during conveyance (e.g., gravity no longer accelerates the tool string 200), the running tool can be released by the motorized tool assembly 213. The motorized tool releasable subsection 213 includes an electric motor and a release mechanism including dogs 249 (as shown in FIG. 5) for releasing the running tool section 202 from the fishing neck disposed on the upper portion of the logging assembly 220. The electric motor can be activated by a signal from the diagnostic module in the logging assembly after the diagnostic module has confirmed that the logging assembly is operating properly. The electric motor can actuate the dogs 249 to separate the running tool 202 from the rest of the landing assembly 210. A detailed example implementation is further illustrated in FIG. 5.

In FIGS. 2A to 2K, the logging assembly 220 includes various data logging instruments used for data acquisition; for example, a battery sub section 217 for powering the data logging instruments, a sensor and controller section 221, a telemetry gamma ray tool 231, a density neutron logging tool 241, a borehole sonic array logging tool 243, a compensated true resistivity tool array 251, among others.

Referring to the logging assembly 220 in FIG. 2A. The logging assembly 220 and the landing assembly 210 are separated at the shock sub 215. A proximity detector 285 is installed in the logging tool string 200 at the location below the shock sub 215. The proximity detector 285 may interact with the landing sub 310 to generate a signal indicating the landing of the logging tool string 220. For example, the proximity detector 285 may use electromagnetic, mechanical and other principles to interact with the landing sub 310. The landing sub 310 may use permanent magnets to actuate a switch in the proximity detector 285. Details of the proximity detector 285 are illustrated in FIGS. 4A to 4E.

In FIG. 2B, the battery sub section 217 is integrated into the logging tool string 200 for providing onboard power to the logging tools. The battery sub section 217 can include high capacity batteries for logging assembly 220's extended use. For example, in some implementations, the battery sub section 217 can include an array of batteries such as Lithium ion, lead acid batteries, nickel-cadmium batteries, zinc-carbon batteries, zinc chloride batteries, NiMH batteries, or other suitable batteries. The battery sub section 217 is monitored and controlled to conserve energy consumption before the landing of the logging tool string 200. For example, the battery system can be put to a stand-by or sleep mode before data logging activities are desired.

Figure 6:
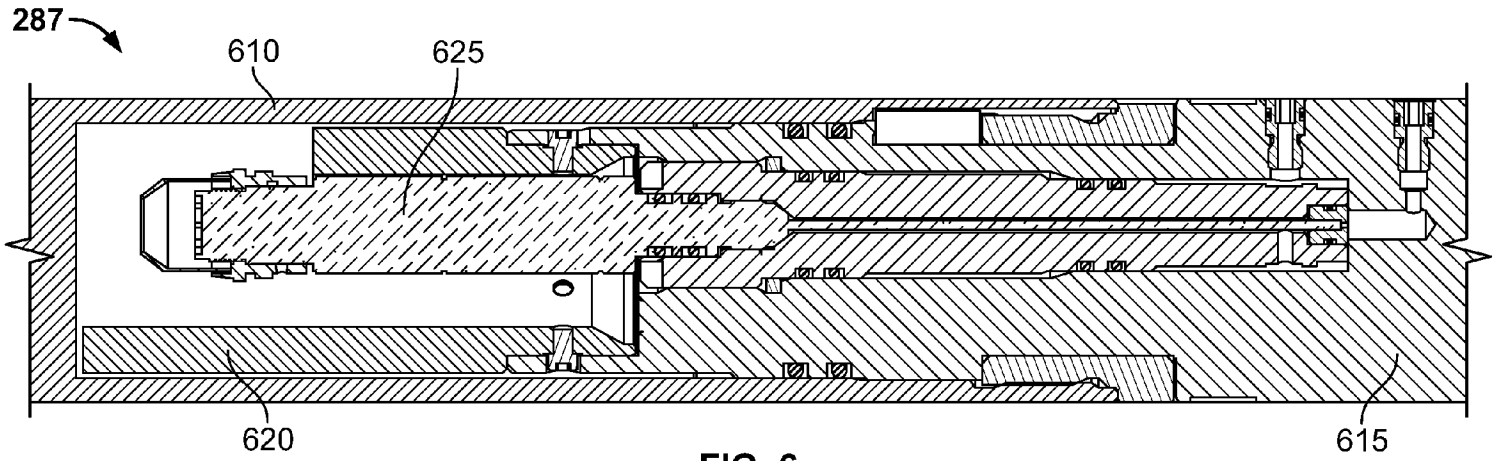
FIG. 6 is a detail half cross section view of a pressure transducer illustrated in FIG. 2B.

A pressure sensor 287 is placed next to the battery sub section 217. The pressure sensor 287 can measure the pressure of surrounding fluid at the location where it is placed for determining if the logging tool string 200 has reached the landing. The pressure sensor 287 can be any appropriate pressure measurement device using one or more principles of piezoresistive, capacitive, electromagnetic, piezoelectric, optical, and potentiometric methods. In different implementations, the pressure sensor 287 may be referred to under different terms, such as transducer, transmitter, indicator, piezometer, manometer, among other names. FIG. 2B and FIG. 6 illustrate one example implementation applicable to the tool string 200. Other designs, forms, and implementations are possible. A detail half cross section view of the pressure sensor 287 is provided in FIG. 6 and further discussed below.

Figure 7:
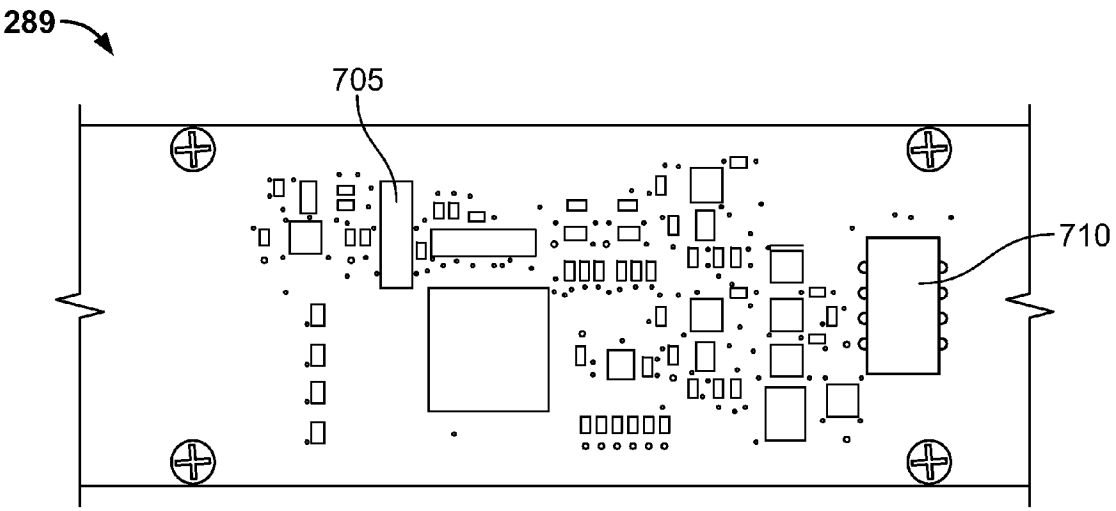
FIG. 7 is a detail view of a temperature sensor and the accelerometer illustrated in FIG. 2C.

In FIG. 2C, the sensor and controller section 221 is integrated to the logging tool string 200. The section 221 includes an onboard controller 222 and a sensor module 289. The onboard controller 222 may include any appropriate processor, memory, input/output interface, and other components for communicating with other logging tool components and sensors to perform intended functions (e.g., data acquisition, command transmission, signal processing, etc.). The sensor module 289 includes a temperature sensor and an accelerometer. The temperature sensor can measure thermal status of the surroundings. The accelerometer can measure vibration and acceleration of the logging tool string to output motion information to the onboard controller/central processor. The module 289 is located onto one or more silicon chips on a circuit board located in the logging assembly 220. A detail example implementation of the module 289 is illustrated in FIG. 7. Other sensors or modules may be included in this section, such as for detecting variables used for control and monitoring purposes (e.g., accelerometers, thermal sensor, pressure transducer, proximity sensor). An inverter may be used for transforming power from the battery sub section 217 into proper voltage and current for data logging instruments.

Figures 2E, 2F, 2G:
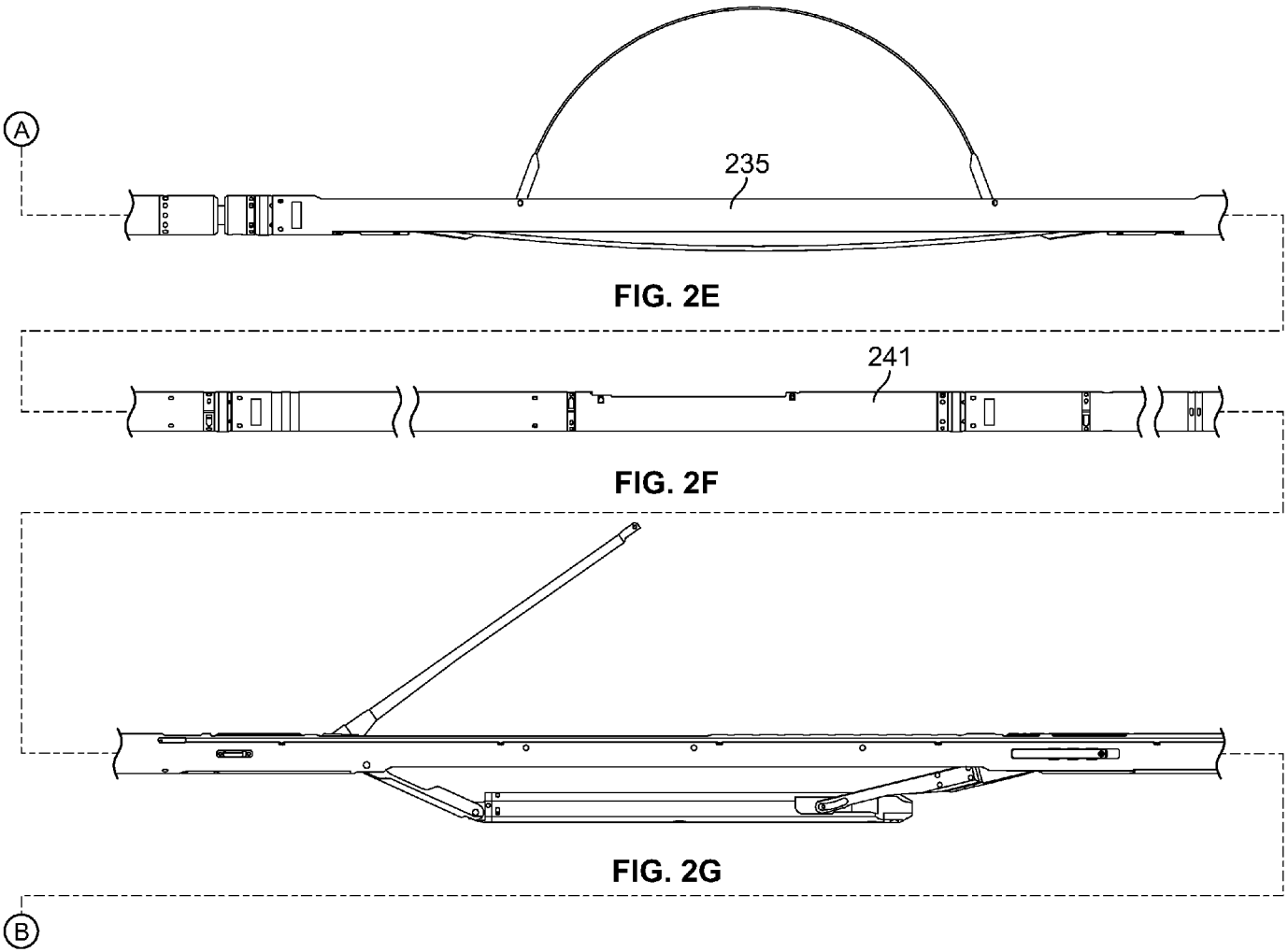

In FIGS. 2D and 2E, the logging assembly 220 further includes the telemetry gamma ray tool 231, a knuckle joint 233 and a decentralizer assembly 235. The telemetry gamma ray tool 231 can record naturally occurring gamma rays in the formations adjacent to the wellbore. This nuclear measurement can indicate the radioactive content of the formations. The knuckle joint 233 can allow angular deviation. Although the knuckle joint 233 is placed as shown in FIG. 2D, it is possible that the knuckle joint 233 can be placed at a different location, or a number of more knuckle joints can be placed at other locations of the tool string 200. In some implementations, a swivel joint (not shown) may be included below the shock sub assembly 215 to allow rotational movement of the tool string. The decentralizer assembly 235 can enable the tool string 200 to be pressed against the wellbore 150.

In FIGS. 2F to 2I, the logging assembly 220 further includes the density neutron logging tool 241 and the borehole sonic array logging tool 243.

Figures 2H, 2I, 2J, 2K:
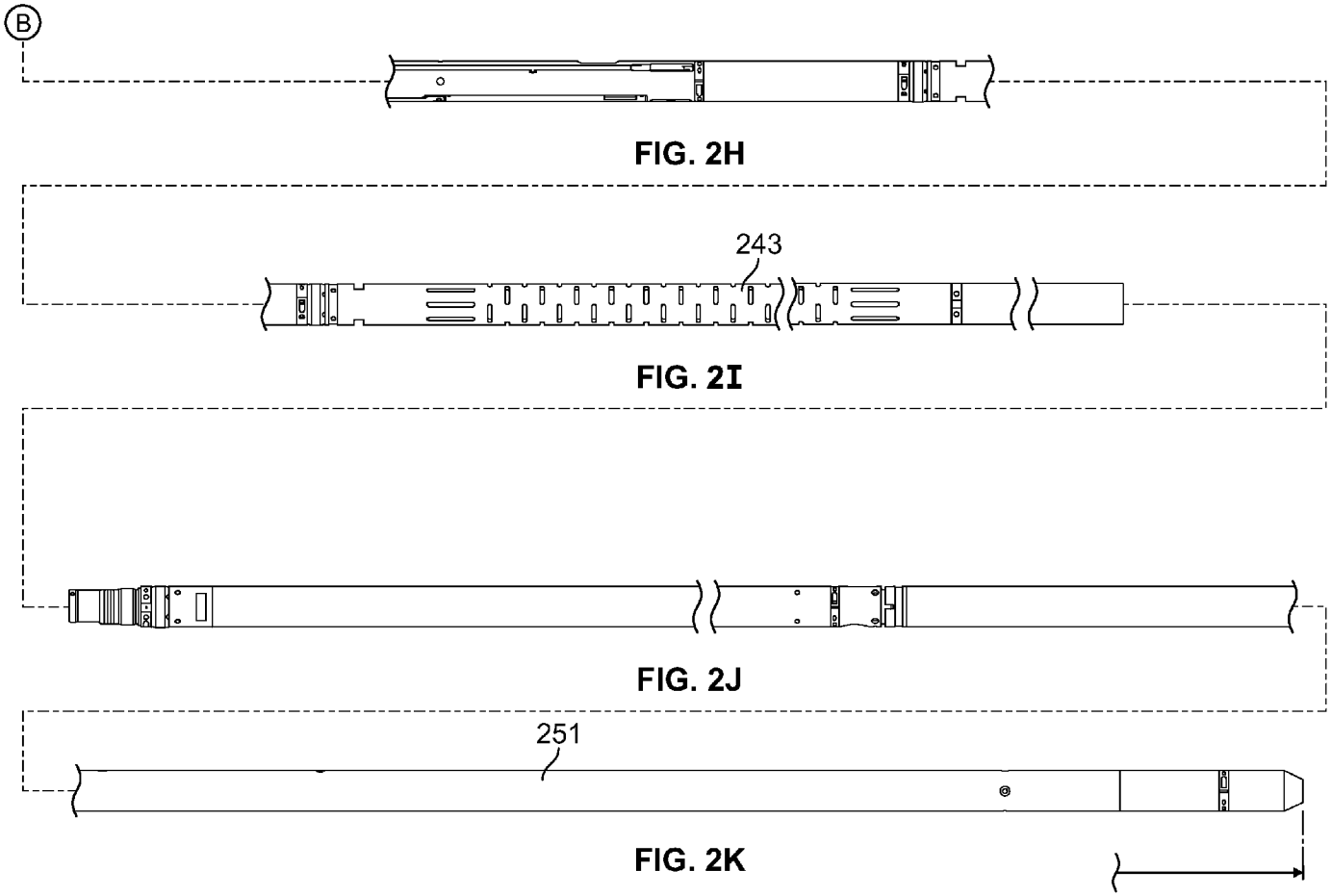

In FIGS. 2E and 2K, the logging assembly 220 further includes the compensated true resistivity tool array 251. In other possible configurations, the logging assembly 220 may include other data logging instruments besides those discussed in FIGS. 2A through 2K, or may include a subset of the presented instruments.

Figure 3A:
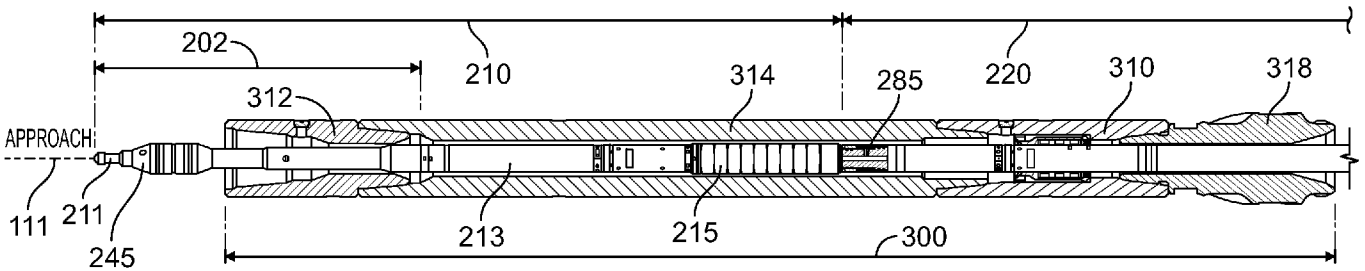
FIGS. 3A to 3C are partial cross-sectional side views of the logging tool string inside a bottom hole assembly of a drill string during different operational phases.
Figure 3B:
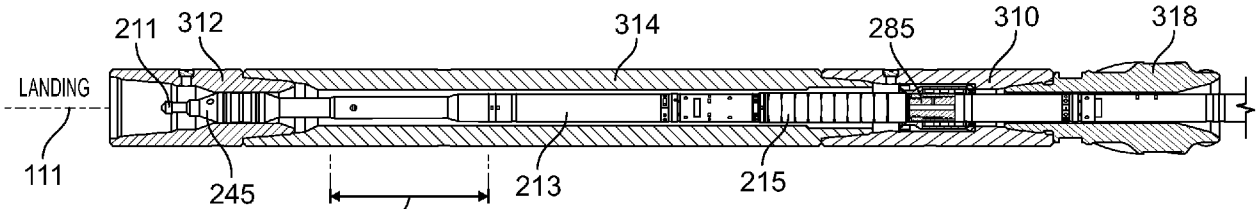
Figure 3C:
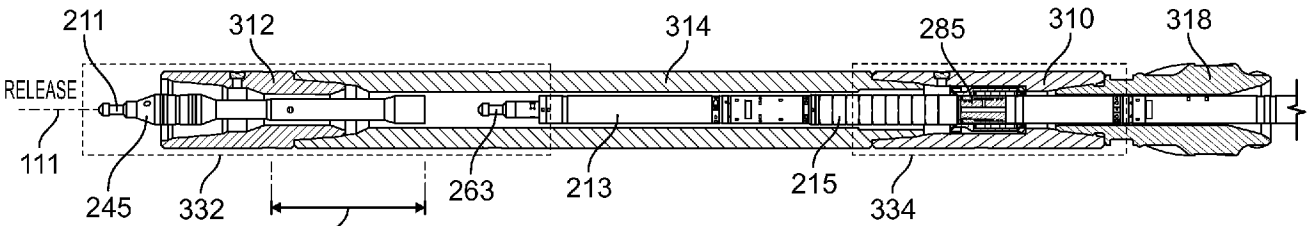

FIGS. 3A to 3C are partial cross-sectional side views of the logging tool string 200 inside the bottom hole assembly 300 during different operation phases. FIG. 3A shows the operation of the logging tool string 200 approaching the bottom hole assembly 300, which can correspond to the scenario shown in FIG. 1B. FIG. 3B shows the operation of the logging tool string 200 landing onto the bottom hole assembly 300, which can correspond to the scenario shown in FIG. 1C. FIG. 3C shows the operation of the logging tool string 200 releasing the running tool 202 after landing onto the bottom hole assembly 300, which can correspond to the scenario shown in FIG. 1D. FIG. 3C further illustrates two detail views: the landing switch detail view 334 and the release operation detail view 332, which are respectively illustrated in FIGS. 4A to 4E, and FIG. 5.

In a general aspect, referring to FIGS. 3A to 3C, the bottom hole assembly 300 can include four major sections: the nozzle sub 312, the spacer sub 314, the landing sub 310, and the deployment sub 318. The nozzle sub 312 may be configured such that the tool string 200 can be received at and guided through the nozzle sub 312 when the tool string 200 enters the bottom hole assembly 300 in FIG. 3A. The spacer sub 314 separates the nozzle sub 312 and the landing sub 310 at a predetermined distance. The landing sub 310 can include a landing sleeve 340 that receives the tool string 200 during landing. For example, the landing sub 310 can include a landing shoulder, a fluid by-pass tool, and a number of control coupling magnets for the landing operation. Details of the components and operation mechanisms are described in FIGS. 4A to 4E and 5. The deployment sub 318 can be the lowermost distal piece of the bottom hole assembly 300 constraining the logging assembly 220, which extends beyond the deployment sub 318 with data logging instruments. In some implementations the deployment sub 318 may be replaced with a modified reamer or hole opener for reaming through a tight spot in the previously drilled wellbore, each of which may be configured to have a longitudinal passage adapted to allow the passage of the logging assembly therethrough. In other implementations, the deployment sub may not be present and the landing sub may include a lower cutter or reamer that would provide the ability to ream through a tight spot in the preexisting well bore.

Referring to FIG. 3A, the tool string 200 is approaching the bottom hole assembly 300 for landing. The shock sub 215 may have an outer diameter larger than the non-compressible outer diameter of the instruments in the logging assembly 220, so that the logging assembly 220 can go through the landing sub 310 without interfering with the bottom hole assembly 300. The non-compressible outer diameter of the instruments in the logging assembly 220 fits into the inner diameter of the landing sub 310, centralization of the logging tool 220 through and immediately beyond the deployment sub 318. The shock sub 215's outer diameter is larger than the inner diameter of the landing sub 310 so that the shock sub 215 can land onto the landing sub 310. For example, at landing the shock sub 215 can impact on the landing shoulder of the landing sub 310 and cease the motion of the tool string 200, as illustrated in FIG. 3B.

In FIG. 3B, the tool string 200 has landed in the landing sub 310. The landing engagement may further be illustrated in FIGS. 4A-4E, where various actuation switches can be implemented for monitoring the landing of the logging tool string 200. For example, in FIG. 4A, a reed switch is used to determine if the shock sub 215 has reached the correct landing. A landing sleeve 340 is centrally placed in the landing sub 310. The landing sleeve 340 has structural features such as the landing shoulder 344. The landing shoulder 344 can be profiled to receive the shock sub 215 with an area of contact. The landing sleeve 340 houses a number of magnets 366 that can be used to actuate reed switches 264 in the tool string 200. The reed switches 264 are installed inside a reed switch housing 260 abutting the shock sub 215 in the tool string 200. The reed switches 264 can be actuated by the magnets 366 when the tool string 200 is landed at the position where the magnetic field created by the magnets 366 can close the switch 264. For example, the reeds 270*a* and 270*b* can be deflected to contact each other. The magnets 366 can be permanent magnets or electromagnets. Other types of switch implementations are possible. For example, besides reed switch, proximity sensor, mechanical switch, and other actuation switches may be used. In some implementations, the actuation switches may be solely relied on for sensing landing. The actuation switches illustrated in FIGS. 4A-4E may initiate a self-diagnosis program for checking the operability and/or send signals to the onboard controllers to confirm landing of the tool string 200. In some implementations, the release of the fish neck 263 shown in FIG. 3C may also depend on the signal sent by the reed switch.

In FIG. 3C, after the tool string 200 is properly landed on the bottom hole assembly 300 and the reed switch 264 is activated and has been at position for at least a predetermined time period, the running tools 202 can be released from the rest of the tool string 200. The activation command requires that the reed switch 264 remain closed for a pre-determined time period to eliminate false activations from magnetic anomalies found in the drill pipe. The release operation occurs at the motorized tool releasable subsection 213, where the spring release assembly 261 becomes disengaged from the fishing neck 263. The releasing operation can further be illustrated in FIG. 5, where the release operation detail view 332 is shown. Briefly referring to FIG. 5, the spring release assembly 261 is connected to the cable 111 through the crossover tool 211, the nozzle 245 and the extension rod 247. The nozzle 245 can seal with the nozzle sub 312 when the tool string 200 is landed to produce a distinct fluid pressure signature (see FIG. 7). The spring release assembly 261 may include a housing 256, a spring 258, and engaging dogs 249. At release in FIG. 3C, the running tool 202 is moved towards the surface 105 via reeling in the cable 111 at the logging truck 115. In some implementations, the running tools 202 may have been released before landing, depending on technical requirement in specific situations.

It will be understood that other implementations of switches may be used instead of a reed switch. For example referring to FIG. 4B wherein is illustrated an implementation using a mechanical switch 265. The mechanical switch accomplishes the same function as all the other embodiments of sensing when the tool has landed in the landing sub and sends an on/off command to the logging tool string. The mechanical switch is triggered when a spring loaded plunger is depressed as the shock sub engages the landing sub.

Figure 4A:
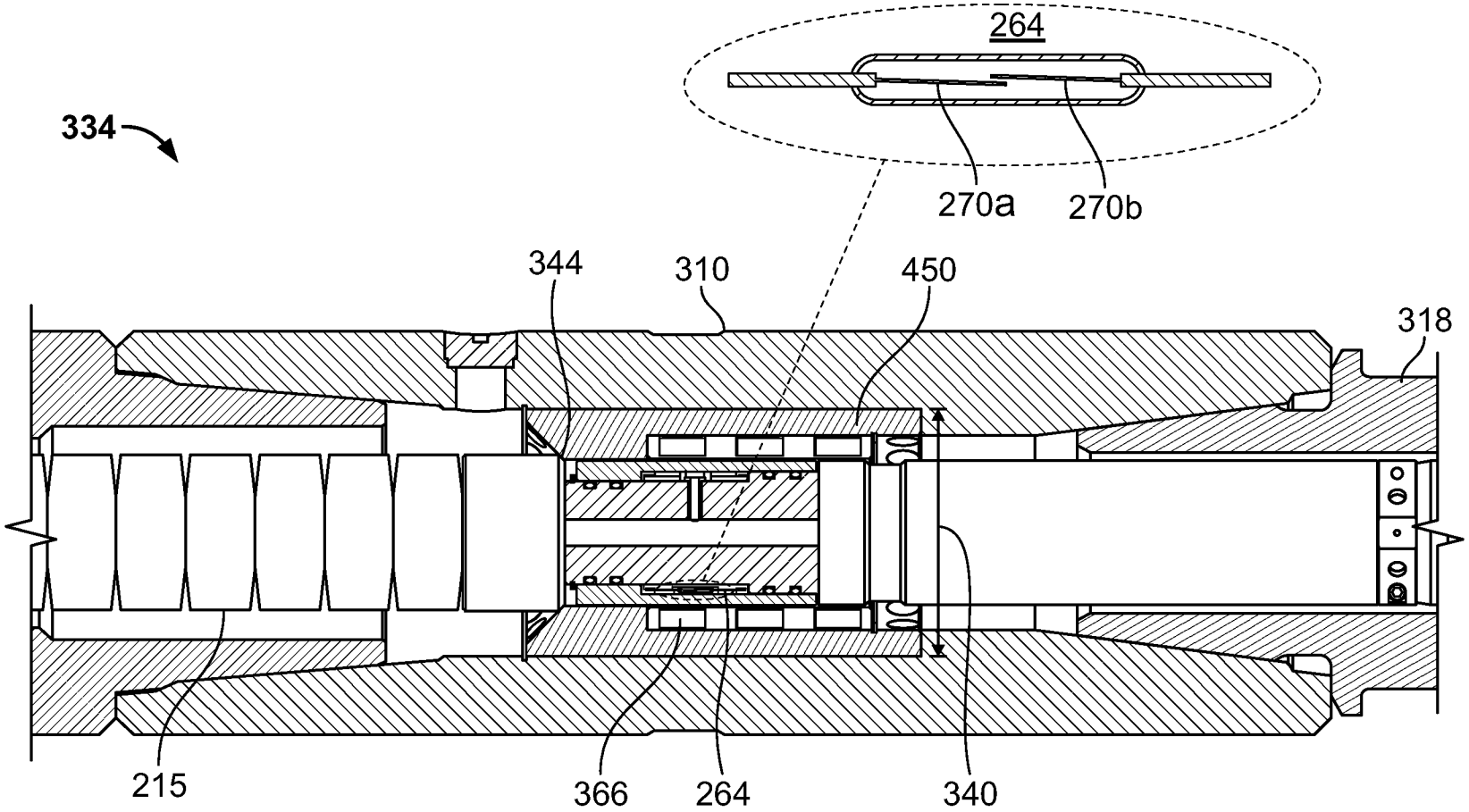
FIGS. 4A to 4E are detail half cross-sectional views of a portion of the logging tool string and the bottom hole assembly illustrating different implementations of a position sensor.
Figure 4B:
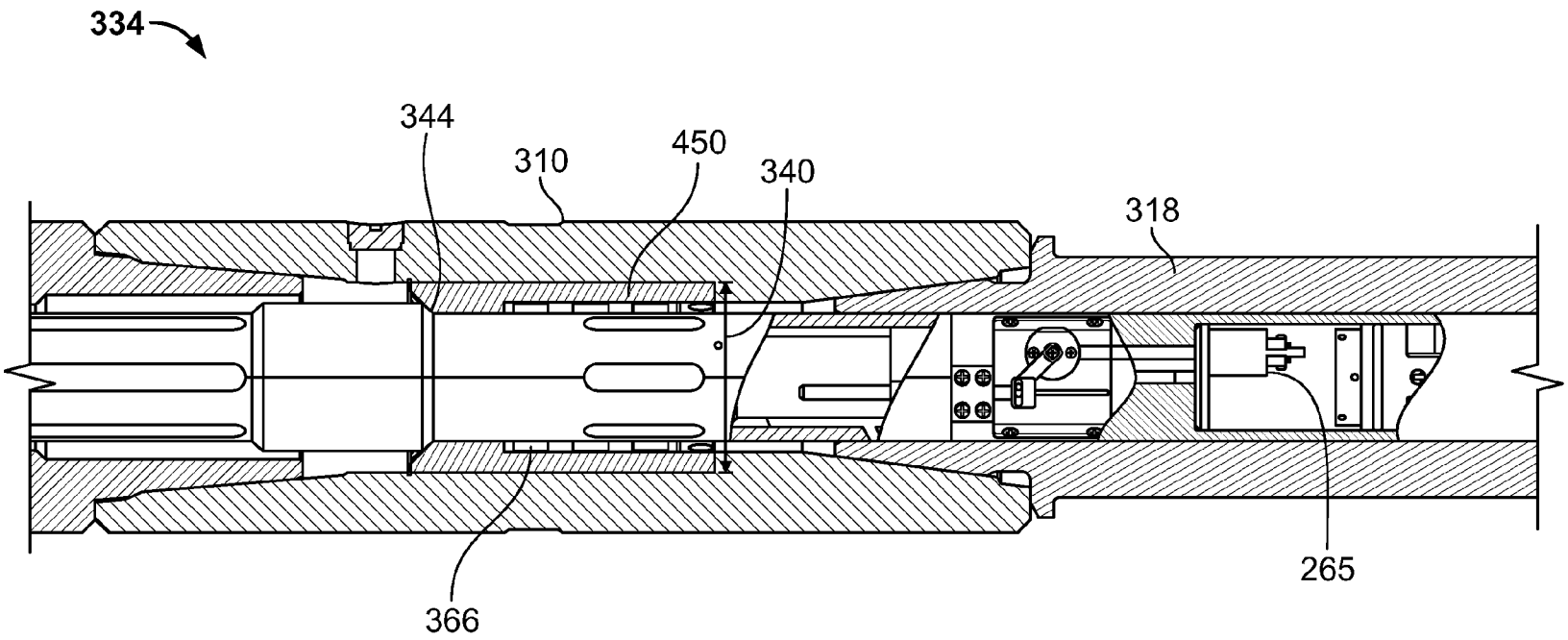
Figure 4C:
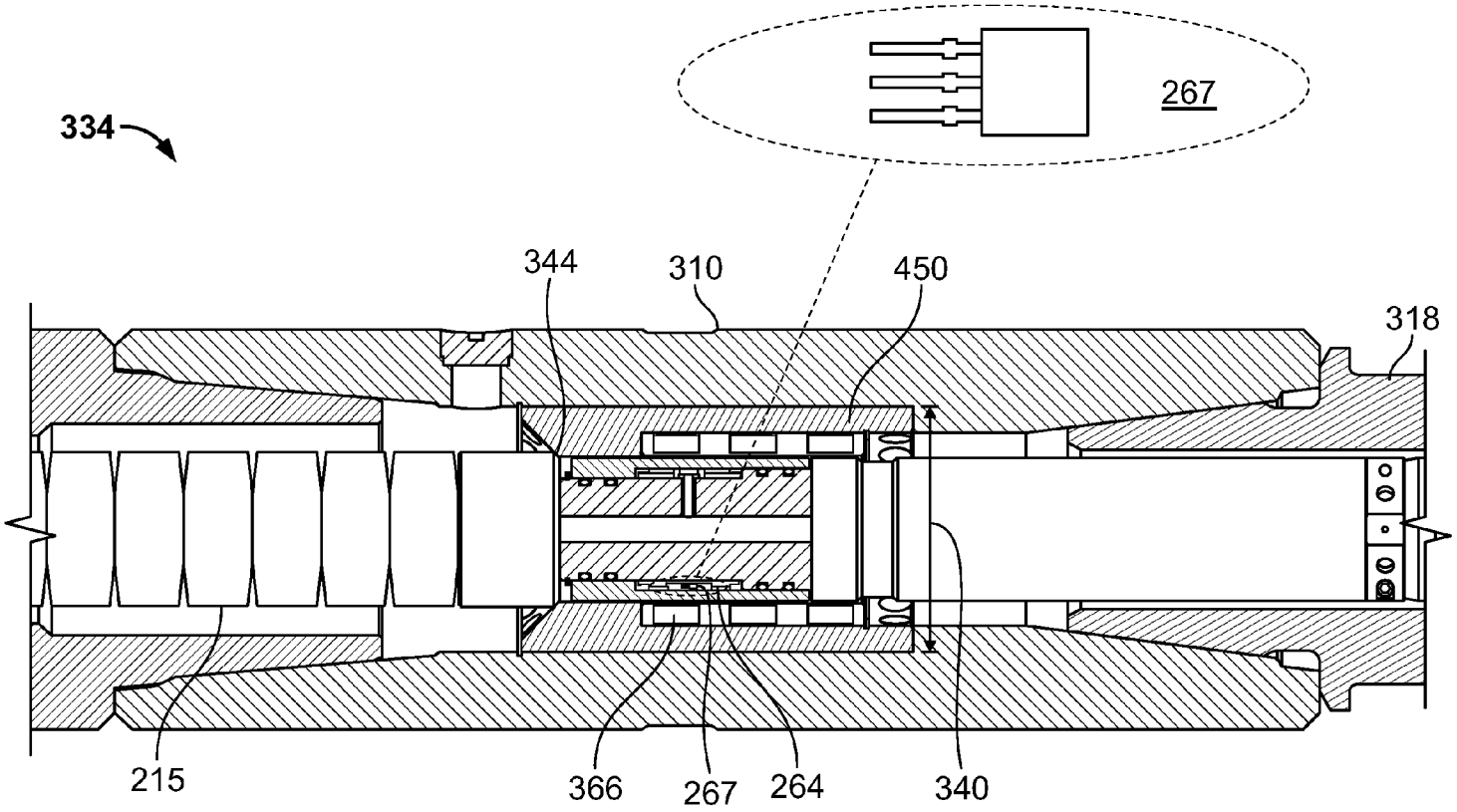

In another implementation, referring to FIG. 4C, a Hall Effect Sensor 267 is used as a switch. The Hall Effect Sensor is an analog transducer that varies its output voltage in response to a magnetic field. Hall Effect Sensors can be combined with electronic circuitry that allows the device to act in a digital (on/off) mode, i.e., a switch. In this implementation, rare earth magnets located in the landing sub trigger the Hall Effect Sensor.

Figure 4D:
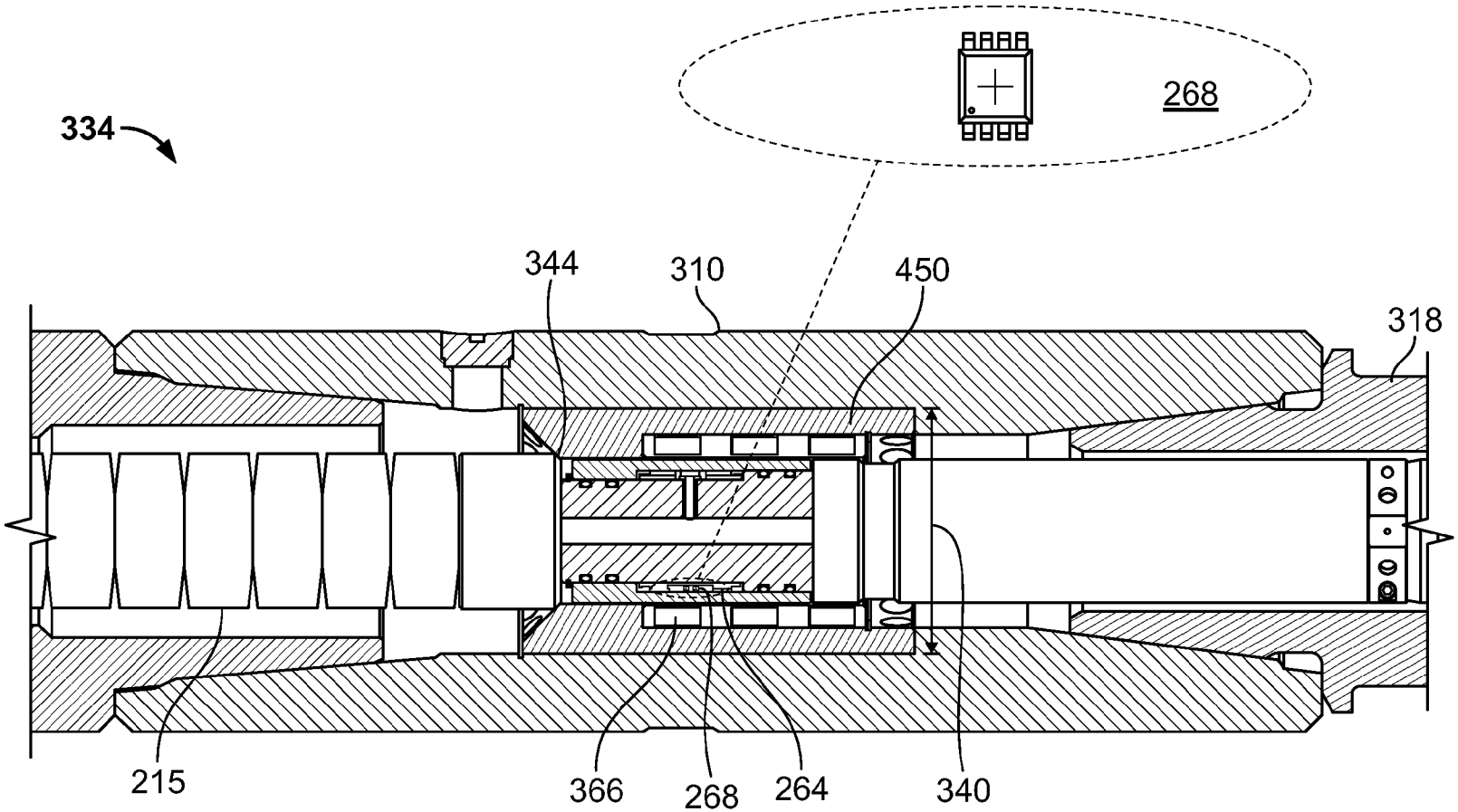

In another implementation, referring to FIG. 4D, a GMR or "Giant Magneto Restrictive" 268 is used as a switch. In some implementations a GMR is formed of thin stacked layers of ferromagnetic and non-magnetic materials which when exposed to a magnetic field produces a large change in the device's electrical resistance. The magnetic flux concentrators on the sensor die gather the magnetic flux along a reference axis and focus it at the GMR bridge resistors in the center of the die. The sensor will have the largest output signal when the magnetic field of interest is parallel to the flux concentrator axis and can be combined with electronic circuitry that allows the device to act in a digital (on/off) mode, i.e., switch. The trigger for this embodiment would be rare earth magnets located in the landing sub.

Figure 4E:
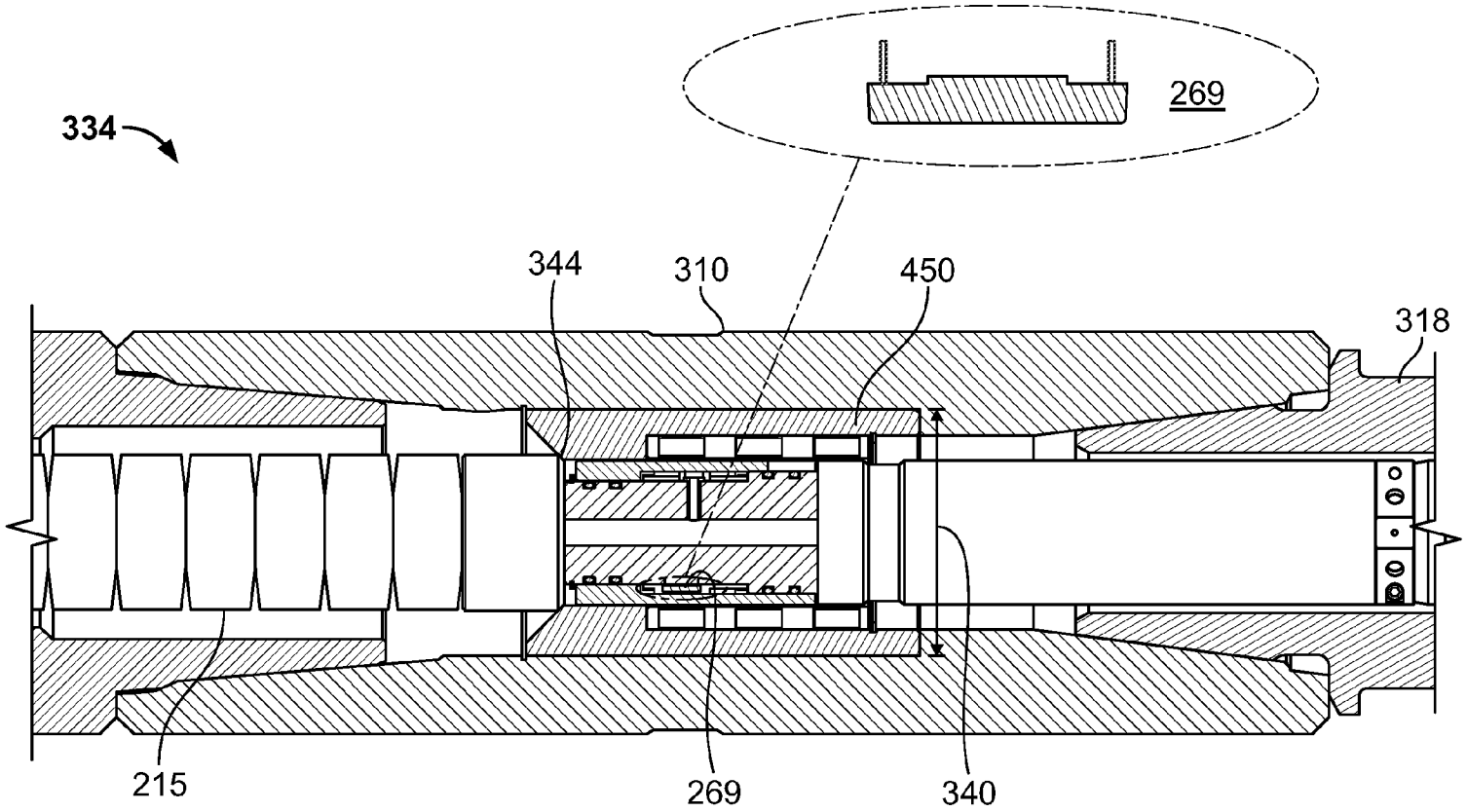

In another implementation, referring to FIG. 4E, a proximity sensor 269 is used as a switch. The proximity sensor 269 is able to detect the presence of metallic objects without any physical contact. In some implementations, a proximity detector uses a coil to emit a high frequency electromagnetic field and looks for changes in the field or return signal in the presence or absence of metal. This change is detected by a threshold circuit which acts in a digital (on/off) mode, i.e., switch. The trigger for this embodiment would be a nonferrous sleeve located in the landing bypass sub. In an alternative implementation, the Proximity Detector/Mutual Inductance Sensor 269 could also be relocated in the tool string so that when the tool lands in the landing sub the sensor would be positioned just past the deployment sub and out into the open borehole a short distance past any ferrous metals. The sensor would interpret this as being in the presence of metal and the absence of metal acting as an on/off switch. The landing sleeve 340 includes a wall 450 of increased thickness for supporting a higher landing impact load.

FIG. 6 is a detail half cross-section view of the pressure transducer 625 illustrated in FIG. 2B. The pressure transducer 625 can be installed in a containment created between the upper tool string housing 610 and the lower tool string housing 615. An installation structure 620 can secure the pressure transducer 625 to a sensing location where the sensing portion of the pressure transducer 625 is exposed to external fluids while the rest of the components are sealed from external fluids. Although the pressure transducer 625 is illustrated having few components, in some instances the pressure transducer 625 can include more components than that as illustrated.

FIG. 7 is a detail view of the temperature sensor 705 and the accelerometer 710 illustrated in FIG. 2C. The temperature sensor 705 can be a silicon based thermal sensing integrated circuit that uses the relationship between the voltage of base emitter to temperature for generating temperature measurements. In some implementations, other types of temperature sensors may be employed, such as thermistors, resistance, thermocouples, among others. The accelerometer 710 can be any appropriate accelerometers that generate an electric output signal based on piezoelectric principles, piezoresistive principles, capacitive principles, micro-electro-mechanical systems, and other principles or systems. The accelerometer 710 may measure accelerations in one or more axes in the tool string 200 to determine a sudden landing impact that precedes and indicates the landing of the tool string 200. Both the thermometer and the accelerometer may send measured signals to the onboard controller for initiating data logging after landing.

Figure 8A:
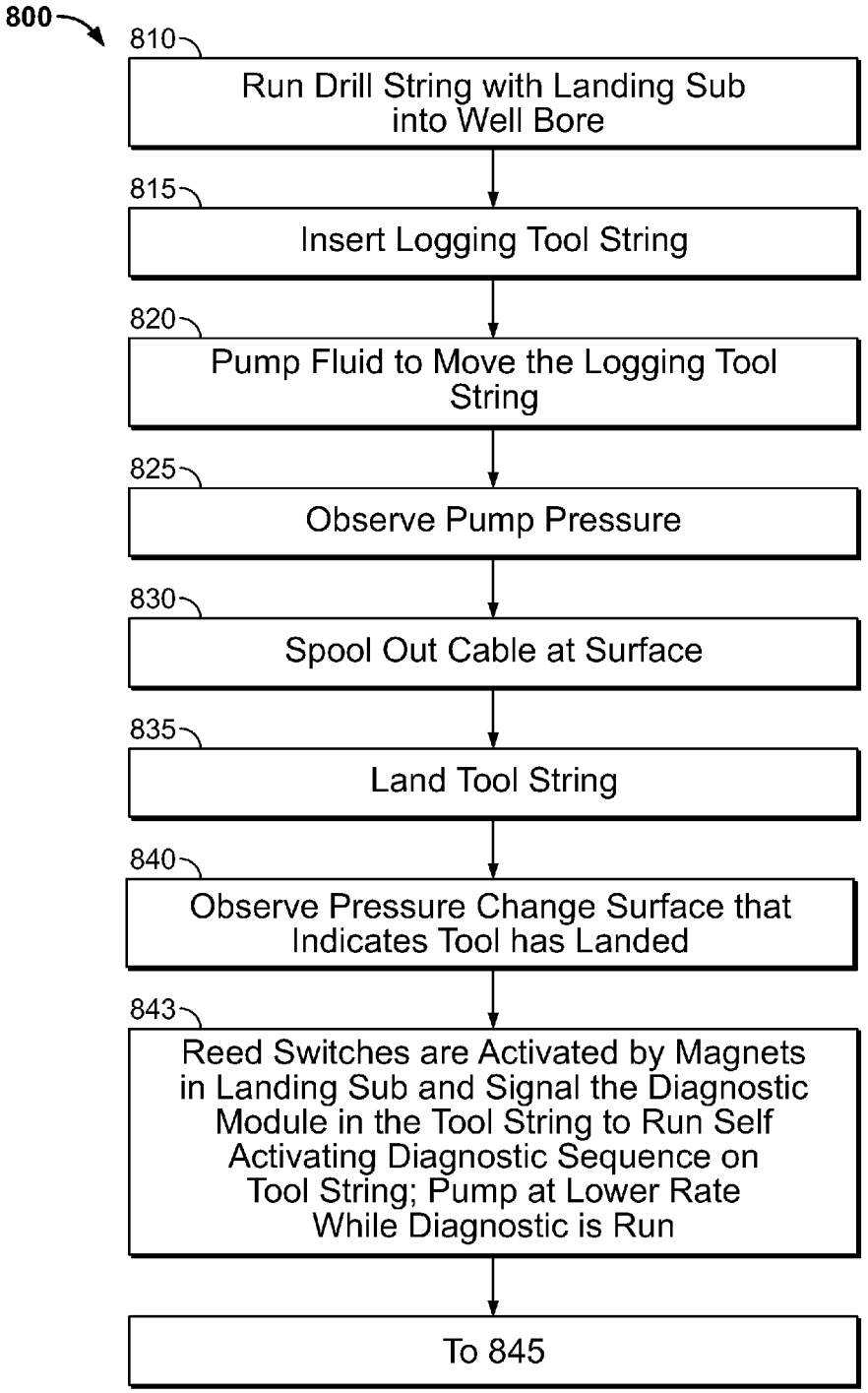
FIGS. 8A and 8B are a flow chart illustrating the operations of landing the logging tool string in the bottom hole assembly of the drill string.
Figure 8B:
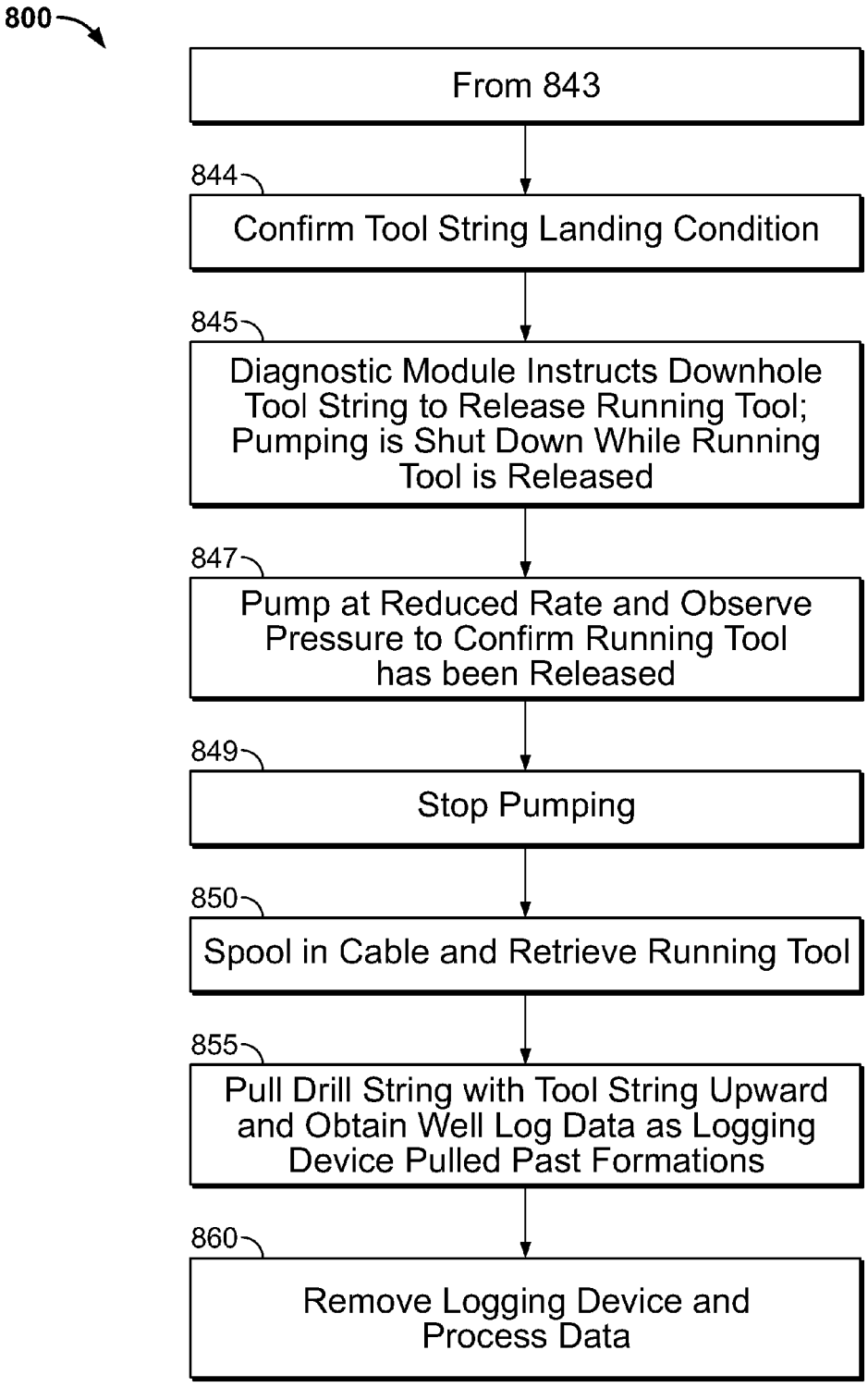

FIGS. 8A and 8B are flow chart 800 illustrating the operations of landing the logging tool string 200 in the bottom hole assembly 300. Referring to FIG. 8A and the prior figures, at 810, a drill pipe string is run into a wellbore to a predetermined position. The drill pipe has a longitudinal bore for conducting fluids, for example, drilling fluids, lubrication fluids, and others. The drill pipe string can include a landing sub with a longitudinal bore disposed proximal to the lower end of the drill pipe string. For example, the landing sub 310 can be part of a bottom hole assembly 300 installed at the lower end of the drill pipe string. In some implementations, the step 810 may be represented in FIG. 1A, where the wellbore 150 has a substantially deviated section and the drill pipe string 114 is run into the wellbore 150.

At 815, a logging tool string is inserted into the upper end of the bore of the drill pipe string. The logging tool string 200 may have a battery powered memory logging device, which may be powered up and initiate data logging after the landing of the logging tool string 200 to the landing sub 310. The logging tool string may be attached to a cable via a crossover tool. The cable may be used to lower the logging tool string into the wellbore at a desired velocity. In some implementations, the step 820 may be represented in FIG. 1B, where the logging tool string 200 is inserted into the pipe string 114 at the upper end near the surface 105. The logging tool string 200 can have a running tool 202 (as in FIGS. 1D and 2A) and can be attached to the cable 111 via the crossover tool 211.

At 820, a fluid is pumped into the upper proximal end of the drill string bore above the logging tool string to assist movement of the tool string down the bore of the drill string. The fluid pressure can be applied onto the logging tool string to propel the downward movement of the tool string, such as when the tool string enters a deviated portion of the well where gravity does not pull the tool string downward. The fluid pressure may also be monitored at the surface in real time to determine the status of the logging tool string at 825. The fluid pressure (with certain noise) is reflective of the speed that the tool is moving down the drill string bore and the rate at which fluid is being pumped through the drill string. The speed of movement is reflective of the speed at which the cable is spooled out at the surface as the fluid is pumped behind the logging tool string and the logging tool string is moving down the longitudinal bore of the drill pipe string at 830. As noted above in some implementations, the logging tool string is not "pumped down" the drill pipe string.

At 835, the tool string is landed in the landing sub of the drill pipe. At least a portion of the tool string that has logging tools (e.g., data logging instrument and equipment) is disposed below the bottom hole assembly 300 located on the distal end of the drill pipe string. For example, the landing procedure may be monitored in the change of the surface fluid pressure at 840, as illustrated in FIG. 9.

Figure 9:
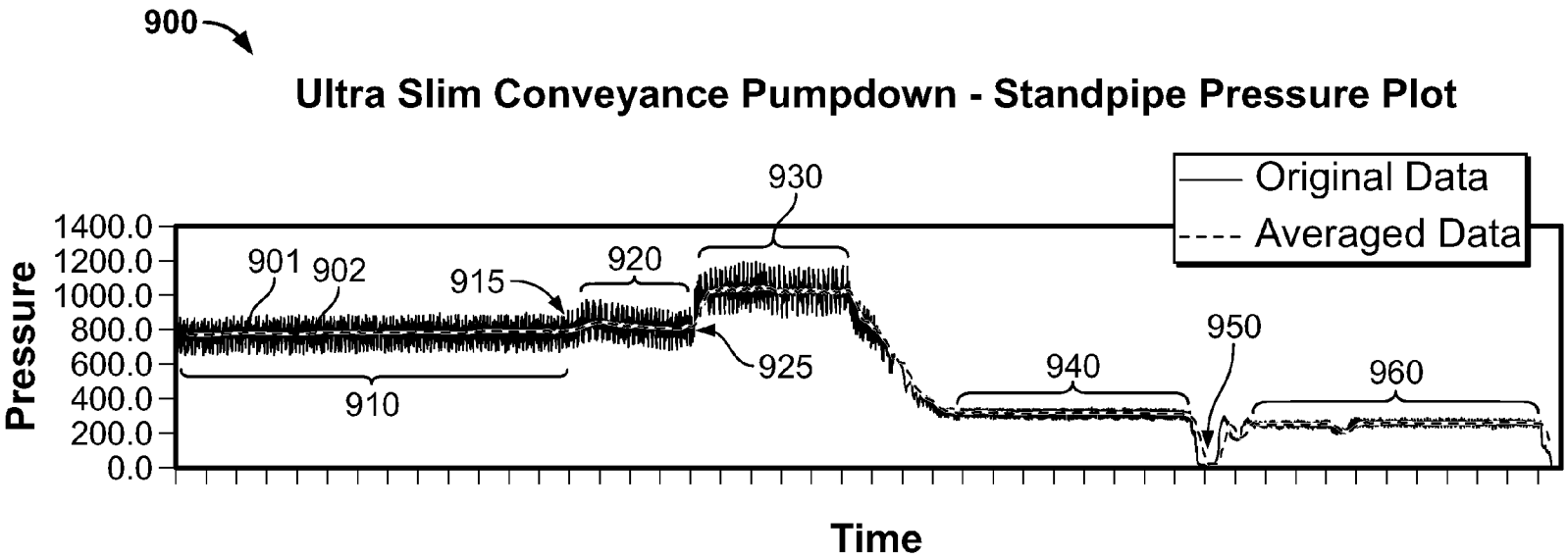
FIG. 9 is an example surface pressure profile for fluid used in the operation of the logging tool system of FIG. 1.

Turning briefly to FIG. 9, an increase in pump pressure at 915 indicates that the tool string has entered the landing sleeve of the landing sub and the annular area between the outside of the tool string and the landing sub has been reduced resulting in a higher fluid pressure. For example, as illustrated in FIG. 3A, the tool string 200 has entered the landing sub 310 but has not yet landed. In FIG. 9, the pressure profile at section 920 is reflective of the tool body and its varying outside diameter passing through the varying inside diameter of the landing sub. The increase of pressure at 915 can be caused by a temporary reduction in cross section for fluid flow when the tool string enters the landing sub. The fluid flow is not interrupted substantially as the tool string continues to move downwards.

At 925, a substantial increase of fluid pressure indicates that the tool string has landed onto the landing sub. This pressure increase can be due to the closing of available flow paths at tool landing. For example, as illustrated in FIG. 3B, the nozzle 245 is inserted into the nozzle sub 312 and the shock sub 215 is pressed against the landing shoulder of the landing sleeve 340 of the landing sub 310. Fluid may continue to flow, though at a higher resistance, through a conduit in the nozzle 245 at an increased pressure. The increased pressure can be observed at 930 as the fluid is circulated through the by-pass.

Returning to FIG. 8A, the increase in pressure observed at 930 in step 840 indicates to the operator that the downhole tool string has landed or at least approaching the landing. At step 843 the reed switches (or other actuation switch are activated when the switches are positioned opposite the magnets in the landing sub). The closing of the reed switch is sensed by an onboard controller in the tool string and can be interpreted as a signal to run a self-diagnostic to determine if the logging tools are functioning properly. While tool string diagnostic is being run downhole, the operator can pump fluid at a lower rate.

At 844, the reed switch confirms the landing of the logging tool string 200. The temperature sensor can wake up the tool from the sleep mode. The tool is initiated to stand by for a reed switch signal. The reed switch signal may be required to meet an initiation condition before the tool starts the sequence to search for the reed switch signal. The sensors send signals to an onboard controller that can initiate data logging based on a confirmation analysis of the incoming data. The sensors include at least a temperature sensor, a real-time clock, a pressure sensor, and an accelerometer. Each sensor may measure continuously and sends the measurement to the onboard controller for analysis. The onboard controller may use the signal from the reed switch to create a time stamp indicating landing. The measurements from the different sensors at the time stamp can be used in the confirmation analysis. For example, the real time clock sends the measurement to the onboard controller, which selects the value (or a series of values) at (or about) the time stamp. The onboard controller compares the measurement value with a threshold value (e.g., an estimated value based on the conveying operation of the tool string, or a manual delay, etc.). Upon a determination that the measurement value is higher than the threshold value, the onboard controller continues the confirmation analysis with other sensors. The onboard controller initiates data logging when all the sensors report a measurement value that is equal or greater than the respective threshold values. In some implementations, the onboard controller can analyze the sensor measurements in parallel (e.g., concurrently) or in a predetermined sequential order.

At step 845, based on the confirmation by the diagnostic sequence run in the tool string that the tool string is operating properly, and the confirmation analysis that affirms each sensor measurement lies in a respective value window, instructions are sent by the onboard controller to release the running tool from the tool string and displace the running tool 202 away from the upper end of the tool string. For example, as illustrated in FIG. 3C, the running tool is released as the spring release assembly 281 disengages with the fishing neck 283. The releasing procedure is also illustrated in FIG. 1D. The operator shuts down pumping while the running tool is being released.

At step 847 pumping is resumed at the rate established in step 843 and the surface pressure is observed to confirm that the running tool has been released. At step 849, pumping is stopped and sustained for a period of time for the crossover tool to be retrieved. This is illustrated in FIG. 9, where at 950 the fluid pressure drops and sustains at zero. For example, in FIG. 9, fluid pressure of section 980 is observed at surface while pumping through the tool string at 3 bbl/min. The pressure observed in section 980 is lower than the previously observed pressure in section 940, indicating the running tool has been displaced from the landing nozzle and the logging tool is properly seated in the landing sub and ready to obtain log data.

At 849 pumping is stopped and after the fluid pressure has been decreased to zero, at step 850 the cable is spooled in at the surface and the running tool is retrieved.

At 855, the drill pipe string is pulled upward in the wellbore, while log data is being recorded in the memory logging device as the data is obtained by the tool string passing by the geologic formations. For example, the data logging can include recording the radioactivity of the formation using a telemetry gamma ray tool, measuring formation density using a density neutron logging tool, detecting porosity using a borehole sonic array logging tool, recording resistivity using a compensated true resistivity tool array, and other information.

At 860, after gathering and storing the log data as the logging device travels to the surface and the drill string is removed from the wellbore, the tool string is removed from the landing sub, the memory logging device is removed. The data in the memory device is then obtained and processed in a computer system at the surface. The data may be processed in the logging truck 115 at the well site or processed at locations remote from the well site.

FIG. 9 is the example pressure profile 900 for conveying logging tools, corresponding to the flow chart 600 illustrated in FIG. 6. The pressure profile 900 shows two data plots of fluid pressure (the y axis) versus time (the x axis). The first data set illustrated by trace 901 represents measured data at a high sampling rate. And the second data set illustrated by trace 902 represents averaged data points using every 20 measured data points. Therefore, the second data set provides a smoothed and averaged presentation of the surface pumping pressure.

Figure 10:
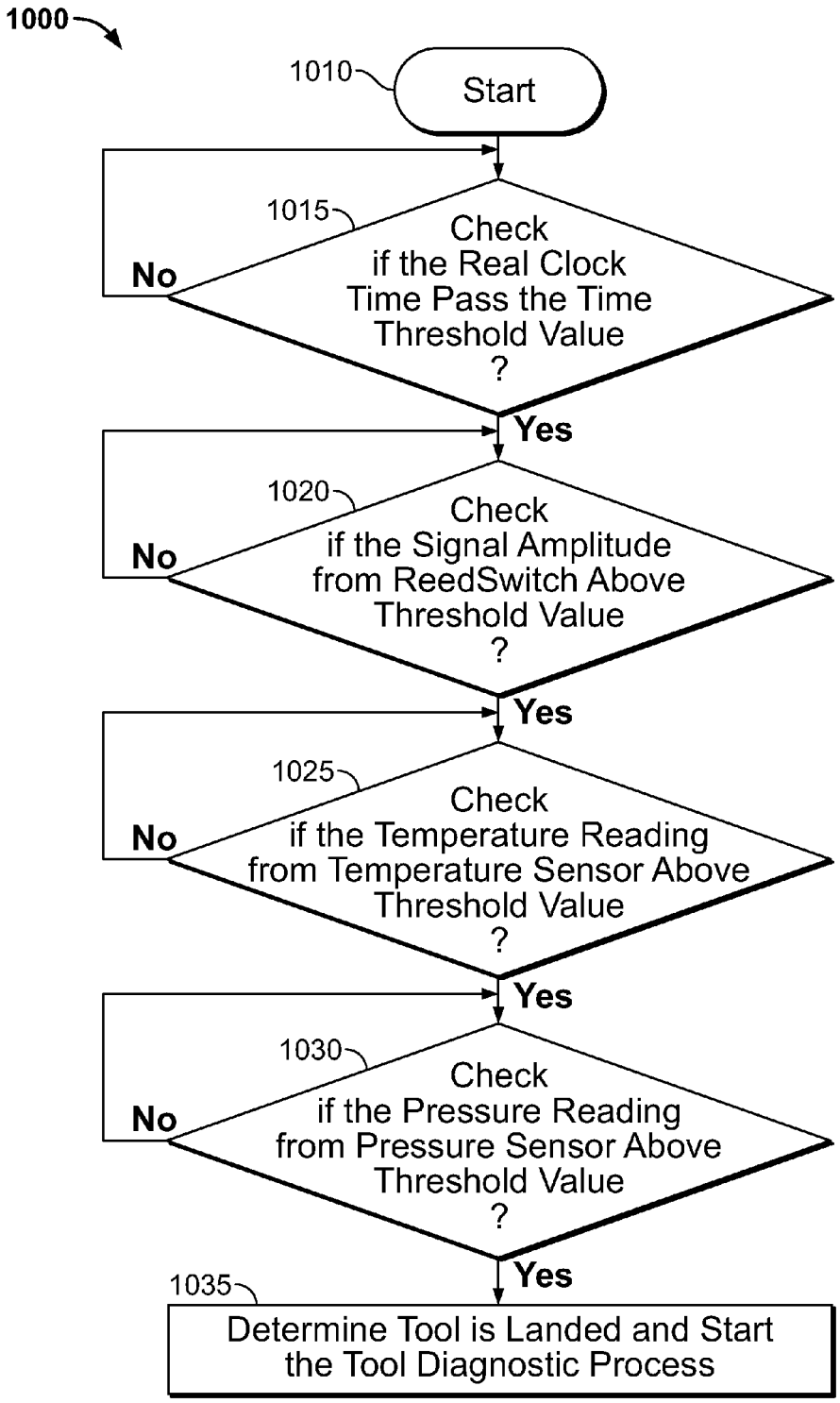
FIG. 10 is a detail flow chart illustrating the detail operation for determining landing of the logging tool string in the bottom hole assembly of the drill string.

FIG. 10 is a detail flow chart 1000 illustrating the detail operation for determining landing of the logging tool. The detail flow chart 1000 may be executed in a routine, program, or algorithm in the onboard controller of the logging tool string 200 for landing confirmation analysis. At 1010, the onboard controller starts the landing confirmation analysis. The onboard controller may analyze a continuous feed of sensor data sequentially, in parallel, or in any pre-prioritized manner. The detail flow chart 1000 illustrates a sequential analysis procedure. At 1015, the onboard controller checks with the data sent from the real time clock to confirm if the measured time has reached or passed the threshold value, which may be pre-programmed by an operator at surface. Upon a determination that the measured time has passed the threshold value, the onboard controller continues with step 1020; otherwise the onboard controller returns to step 1015. For example, a return operation allows more time to elapse until the threshold value can be passed.

At 1020, the onboard controller checks with the data sent from the reed switch (or any of the actuation sensor as illustrated in FIGS. 4A to 4E) to confirm if the measured voltage has passed a threshold value that may be based on empirical data or other criteria. For example, the threshold value may be set at 1.65 V based on regular configuration. Upon a determination that the measured voltage has reached or passed 1.65 V, the onboard controller continues with step 1025; otherwise the onboard controller returns to step 1020. Reaching or passing the 1.65 V indicates the tool string has landed.

In a similar manner at steps 1025 and 1030, the onboard controller analyzes the measurements from the temperature sensor and the pressure sensor. The measured temperature may be compared against a threshold value estimated based on the depth of the tool string and the geographical/geological properties of the well (e.g., affected by geothermal activities, etc.). The measured pressure may be compared against a threshold value estimated based on the operation of the surface pump, a reference pressure profile (e.g., profile 900 in FIG. 9), or with other methods. The onboard controller proceeds when each of the measured values reaches or passes the respective threshold value; otherwise repeat the respective step until the value is reached and/or passed.

In some implementations, step 1015 is prioritized for confirming enough time has been elapsed before self-diagnostic or data logging operations can be initiated. For example, there can be a minimal time estimation for conveying the tool string to the bottom of the drill pipe. After 1015, the confirmation of the landing proximity (e.g., reading from the reed switch), the pressure measurement, and the temperature measurement may be in arbitrary order (e.g., a sequential order different from as illustrated in FIG. 10, or in parallel, etc.).

At 1035, the onboard controller has determined that the logging tool has landed based on the confirmation analysis performed using measurements from the time, proximity, pressure, and temperature sensors. The logging tool self-diagnostic process is then initiated. The subsequent operation may assume from step 845 of FIG. 8B. The time, pressure, and temperature sensors may further participate in the subsequent data logging activities.

A number of implementations have been described. Nevertheless, it will be understood that various modifications may be made. Further, the method 600 may include fewer steps than those illustrated or more steps than those illustrated. In addition, the illustrated steps of the method 600 may be performed in the respective orders illustrated or in different orders than that illustrated. As a specific example, the method 600 may be performed simultaneously (e.g., substantially or otherwise). Other variations in the order of steps are also possible. Accordingly, other implementations are within the scope of the following claims.

What is claimed is:

1. A method of determining landing of a well tool comprising:

(a) running a drill pipe string having a longitudinal bore into a well bore to a predetermined position, said drill pipe string including a landing sub disposed proximal to a lower end of the drill pipe string;

(b) inserting a logging tool string into a proximal upper end of the longitudinal bore of the drill pipe string, said logging tool string comprising a running tool attached to a cable, a landing assembly, an onboard controller and one or more logging tools;

(c) pumping a fluid into the proximal upper end of the longitudinal bore of the drill pipe string above the logging tool string to assist, via fluid pressure on the logging tool string, movement of the logging tool string down the longitudinal bore of the drill pipe string;

(d) spooling out the cable at the surface as the fluid is pumped behind the logging tool string and the logging tool string is moving down the longitudinal bore of the drill pipe string;

(e) landing the landing assembly of the logging tool string in the landing sub of the drill pipe string, wherein at least a portion of the logging tool string including the one or more logging tools is disposed below a distal end of the drill pipe string;

(f) analyzing data from a plurality of sensors in the logging tool string with the onboard controller and determining with the onboard controller that the landing assembly of the logging tool string has landed in the landing sub; and (g) upon determining that the landing assembly has landed in the landing sub, sending by the onboard controller one or more signals to the one or more logging tools in the logging tool string.

2. The method of claim 1 wherein the one or more signals to the one or more logging tools comprises at least one instruction to gather and store log data.

3. The method of claim 1 wherein determining with the onboard controller that the landing assembly of the logging tool string has landed in the landing sub comprises comparing a measured value from the plurality of sensors to a respective predetermined threshold value corresponding to each of the plurality of sensors.

4. The method of claim 1 further comprising:

activating and running by a diagnostic module located in the logging tool string a diagnostic test of the one or more logging tools to determine that the one or more logging tools are functioning properly; and sending instructions by the diagnostic tool to a release mechanism located in the logging tool string to release the running tool portion of the tool string.

5. The method of claim 4 further including:

observing a decrease in pump pressure at the surface indicative of a release of the running tool from a remaining portion of the logging tool string; and spooling in the cable at the surface and retrieving the released running tool.

6. The method of claim 5 further including pulling the drill pipe string upward in the well bore and recording data obtained by the one or more logging tools as the one or more logging tools are pulled upward by the drill pipe string.

7. The method of claim 6 further including removing a memory logging device from the logging tool string and processing recorded data in a computer system at the surface.

8. The method of claim 7 wherein removing the memory logging device from the logging tool string includes lowering on a cable a fishing tool adapted to grasp a fishing neck on an upper end of the logging tool string disposed in the landing sub in the drill pipe string, while the logging tool string and drill pipe string are still in the well bore.

9. The method of claim 7 wherein removing the memory logging device from the logging tool string includes removing the drill pipe string from the well bore and removing the logging tool string from the landing sub when the drill pipe string is removed from the well bore.

10. The method of claim 1 wherein analyzing data from a plurality of sensors in the logging tool string with the onboard controller further comprises:

receiving data from a first sensor for detecting proximity between the logging tool string and the landing sub;

receiving data from a second sensor for measuring real time;

receiving data from a third sensor for measuring temperature; and receiving data from a fourth sensor for measuring acceleration.

11. The method of claim 10 wherein the one or more signals to the one or more logging tools comprises instructions to activate previously inactive logging tools and to gather and store log data.

12. An assembly for determining landing of a well tool, comprising:

a bottom hole assembly adapted to be disposed on a distal end of a drill pipe string having a longitudinal bore, said bottom hole assembly including a landing sub having a bore therethrough; and a logging tool string adapted to be inserted into a proximal upper end of the longitudinal bore of the drill pipe string and further adapted such that when the logging tool string is landed in the landing sub at least a portion of the logging tool string is disposed below a distal end of the drill pipe string, said logging tool string including:

a landing assembly, a logging assembly having at least one logging tool adapted to obtain and store data about at least one geologic formation penetrated by a wellbore in which the logging assembly is positioned, and an onboard controller operable to process data from a plurality of sensors to perform a landing confirmation analysis to determine that the landing assembly of the logging tool string has landed in the landing sub, and operable to send one or more signals to the at least one logging tool.

13. The assembly of claim 12, wherein the landing confirmation analysis comprises comparing a measured value from the plurality of sensors to a respective predetermined threshold value corresponding to each of the plurality of sensors.

14. The assembly of claim 12 wherein the plurality of sensors further comprises:

a first sensor for detecting proximity between the logging tool string and the landing sub;

a second sensor for measuring real time;

a third sensor for measuring temperature; and a fourth sensor for measuring acceleration.

15. The assembly of claim 12 wherein the bottom hole assembly has a reamer disposed on a lower end of the bottom hole assembly, said reamer including a bore adapted for passage of the logging tool string therethrough.

16. The assembly of claim 12 wherein the onboard controller is further operable to send one or more signals to one or more logging tools in the logging tool string.

17. The assembly of claim 16 wherein the one or more signals to the one or more logging tools comprises instructions to activate one or more previously inactive logging tools.

18. The assembly of claim 16 wherein the one or more signals to the one or more logging tools further comprises instructions for the one or more logging tools to gather and store data.

19. The assembly of claim 12 wherein the logging assembly further includes a diagnostic module adapted to run a diagnostic sequence to determine if the at least one logging tool is functioning properly and send a signal to a release assembly to release the running tool and cable from the logging tool string.

20. The assembly of claim 19 wherein one or more of the one or more signals sent by the onboard controller further includes notifying the diagnostic module that the logging assembly is in proper position for logging and instructing the diagnostic module to begin the diagnostic sequence on the at least one logging tool.

21. The assembly of claim 12 wherein the bottom hole assembly further comprises a deployment sub disposed on a distal end of the bottom hole assembly, said deployment sub having a longitudinal bore therethrough, said deployment sub adapted to support the logging tool string when the logging assembly is landing in the landing sub and the logging tool string extends through the longitudinal bore of said deployment sub.

22. The assembly of claim 21 wherein the logging tool string is configured to extend below the distal end of the bottom hole assembly when the logging assembly is landed in the landing sub.

23. The assembly of claim 12 wherein the logging assembly further includes a memory module to store data obtained by the at least one logging tool.

24. The assembly of claim 23 further including a battery disposed in the logging tool string for supplying power to the memory module.

25. A logging system for obtaining well log data from a wellbore comprising:

a drill pipe string disposed in the wellbore, said drill pipe string having a longitudinal bore therethrough;

a bottom hole assembly adapted to be disposed on a distal end of the drill pipe string, said bottom hole assembly including a landing sub having a bore therethrough with a landing shoulder in said landing sub;

a nozzle sub having a bore therethrough; and a cable adapted to be lowered inside the longitudinal bore of the drill pipe string and retrieved from the drill pipe string;

a logging tool string including a landing assembly having a running tool, said running tool including a crossover tool adapted on an upper end to connect to the cable;

a nozzle member having a profile adapted to be received in the bore of the nozzle sub; and a release assembly;

a logging assembly having at least one logging tool adapted to obtain data about at least one geologic formation penetrated by the wellbore;

a memory module to store the data obtained by the at least one logging tool;

a diagnostic module adapted to run a diagnostic sequence to determine if the at least one logging tool is functioning properly and send a signal to the release assembly;

an onboard controller operable to perform a landing confirmation analysis;

wherein the landing confirmation analysis processes measurement data from a plurality of sensors in the logging tool string; and a surface pump system adapted to pump fluid down the logging tool string behind the at least one logging tool as it is lowered on the cable into the well and further adapted for observation of fluid pressure at the surface.

26. The system of claim 25 wherein the bottom hole assembly further includes a deployment sub disposed on a distal end of the bottom hole assembly, said deployment sub having a longitudinal bore therethrough, said deployment sub adapted to support the logging tool string when the logging assembly is landing in the landing sub and the logging tool string extends through the longitudinal bore of the deployment sub.

27. The system of claim 25 wherein the bottom hole assembly has a reamer disposed on a lower end of the bottom hole assembly, said reamer including a bore adapted for passage of the logging tool string therethrough.

28. The system of claim 25 wherein the logging tool string is configured to extend below the distal end of the bottom hole assembly when the logging assembly is landed in the landing sub.

29. The system of claim 25 wherein the nozzle includes a flow conduit therethrough that is adapted to allow fluid flow from the longitudinal bore of the drill pipe string through the logging tool string and a fluid bypass disposed in the landing sub.

30. The system of claim 25, wherein the plurality of sensors further comprises:

a first sensor for detecting proximity between the logging tool string and the landing sub;

a second sensor for measuring real time;

a third sensor for measuring temperature; and a fourth sensor for measuring acceleration.

31. The system of claim 30 wherein a signal is sent by the first sensor to notify the diagnostic module that the logging assembly is properly positioned for logging and that the diagnostic module may begin the diagnostic sequence on the at least one logging tool.

32. The system of claim 25 wherein the logging assembly further includes a memory module to store data obtained by the at least one logging tool.

33. The system of claim 32 further including a battery disposed in the logging tool string for supplying power to the memory module.

34. The system of claim 25 wherein the onboard controller is further operable to send one or more signals to one or more logging tools in the logging tool string.

35. The system of claim 34 wherein the one or more signals to the one or more logging tools comprises instructions to activate one or more previously inactive logging tools.

36. The system of claim 34 wherein the one or more signals to the one or more logging tools further comprises instructions for the one or more logging tools to gather and store data.

* * * * *